US012252772B2

(12) United States Patent
Kirsch et al.

(10) Patent No.: US 12,252,772 B2
(45) Date of Patent: Mar. 18, 2025

(54) METHODS OF COLD FORMING ALUMINUM LITHIUM ALLOYS

(71) Applicant: ARCONIC TECHNOLOGIES LLC, Pittsburgh, PA (US)

(72) Inventors: Logan Kirsch, Lafayette, IN (US); Les A. Yocum, West Lafayette, IN (US); Diana K. Denzer, Lower Burrell, PA (US); Douglas S. Bae, Pittsburgh, PA (US); Andreas K. Kulovits, Pittsburgh, PA (US); Ronald G. Cheney, Chandler, AZ (US)

(73) Assignee: ARCONIC TECHNOLOGIES LLC, Pittsburgh, PA (US)

( * ) Notice: Subject to any disclaimer, the term of this patent is extended or adjusted under 35 U.S.C. 154(b) by 637 days.

(21) Appl. No.: 17/449,856

(22) Filed: Oct. 4, 2021

(65) Prior Publication Data

US 2022/0307119 A1 Sep. 29, 2022

Related U.S. Application Data

(63) Continuation of application No. PCT/US2020/026443, filed on Apr. 2, 2020.
(Continued)

(51) Int. Cl.

| | |
|---|---|
| ***C22F 1/057*** | (2006.01) |
| ***C22C 21/16*** | (2006.01) |
| ***C22C 21/18*** | (2006.01) |

(52) U.S. Cl.
CPC ..... *C22F 1/057* (2013.01); *C22C 21/16* (2013.01); *C22C 21/18* (2013.01)

(58) Field of Classification Search
None
See application file for complete search history.

(56) References Cited

U.S. PATENT DOCUMENTS

| | | | |
|---|---|---|---|
| 4,652,314 | A | 3/1987 | Meyer |
| 4,795,502 | A | 1/1989 | Cho |

(Continued)

FOREIGN PATENT DOCUMENTS

| | | | |
|---|---|---|---|
| DE | 19911717 | A1 | 9/2000 |
| JP | H0689439 | B2 * | 11/1994 |

(Continued)

OTHER PUBLICATIONS

English translation of JP-H0689439-B2 (originally published Nov. 9, 1994), obtained from PE2E search.*

(Continued)

*Primary Examiner* — George Wyszomierski
(74) *Attorney, Agent, or Firm* — Greenberg Traurig, LLP

(57) ABSTRACT

New methods of making cold formed, extruded aluminum lithium alloys, and unrecrystallized products made therefrom are disclosed. A method may include one or more of heating an unrecrystallized extruded aluminum-lithium product to a treatment temperature, cooling the unrecrystallized extruded aluminum-lithium product from the treatment temperature to a post-treatment temperature, and cold forming the unrecrystallized extruded aluminum-lithium product into a second product form. Due to the unique processing conditions of the method, the second product form may wholly or partially retain the unrecrystallized microstructure.

18 Claims, 24 Drawing Sheets

Related U.S. Application Data

(60) Provisional application No. 62/829,799, filed on Apr. 5, 2019.

(56) References Cited

U.S. PATENT DOCUMENTS

| | | | | |
|---|---|---|---|---|
| 4,806,174 | A | 2/1989 | Cho et al. | |
| 4,816,087 | A | 3/1989 | Cho | |
| 4,844,750 | A | 7/1989 | Cho et al. | |
| 4,921,548 | A | 5/1990 | Cho | |
| 4,927,469 | A | 5/1990 | Rioja et al. | |
| 4,939,032 | A | 7/1990 | Petit et al. | |
| 4,947,117 | A * | 8/1990 | Buck | G01N 27/80 324/227 |
| 5,061,327 | A | 10/1991 | Denzer et al. | |
| 5,066,342 | A | 11/1991 | Rioja et al. | |
| 5,108,519 | A | 4/1992 | Armanie et al. | |
| 5,151,136 | A | 9/1992 | Witters et al. | |
| 5,455,003 | A * | 10/1995 | Pickens | C22F 1/04 148/695 |
| 5,938,867 | A | 8/1999 | Dorward et al. | |
| 6,113,711 | A | 9/2000 | Armanie et al. | |
| 6,551,424 | B1 | 4/2003 | Haszler et al. | |
| 6,562,154 | B1 | 5/2003 | Rioja et al. | |
| 6,974,633 | B2 | 12/2005 | Garratt et al. | |
| 8,118,950 | B2 | 2/2012 | Colvin et al. | |
| 8,673,209 | B2 | 3/2014 | Bray et al. | |
| 8,840,737 | B2 | 9/2014 | Bray et al. | |
| 9,194,028 | B2 | 11/2015 | Kamat et al. | |
| 2003/0226935 | A1 | 12/2003 | Garratt et al. | |
| 2007/0000583 | A1 | 1/2007 | Rioja et al. | |
| 2009/0084474 | A1 | 4/2009 | Cheong et al. | |
| 2011/0247730 | A1* | 10/2011 | Yanar | B22D 21/007 148/552 |
| 2012/0055590 | A1 | 3/2012 | Kamat et al. | |
| 2014/0367000 | A1* | 12/2014 | Kamat | C22C 21/18 148/695 |
| 2016/0053357 | A1* | 2/2016 | Bes | C22C 21/16 148/552 |
| 2017/0326690 | A1 | 11/2017 | Heard et al. | |
| 2017/0326868 | A1 | 11/2017 | Heard et al. | |
| 2019/0233921 | A1* | 8/2019 | Long | C22F 1/002 |
| 2019/0309402 | A1 | 10/2019 | Karabin et al. | |
| 2019/0338434 | A1 | 11/2019 | Maddala et al. | |
| 2020/0056268 | A1 | 2/2020 | Heard et al. | |
| 2020/0165707 | A1* | 5/2020 | Whelchel | C22C 21/16 |

FOREIGN PATENT DOCUMENTS

| | | |
|---|---|---|
| WO | WO2019/055623 | 3/2019 |
| WO | WO2019/055630 | 3/2019 |
| WO | WO2019/165136 | 8/2019 |
| WO | WO2019/245922 | 12/2019 |
| WO | WO2020/081150 | 4/2020 |
| WO | WO2020/081157 | 4/2020 |
| WO | WO2020/081255 | 4/2020 |
| WO | WO2020/106601 | 5/2020 |
| WO | WO2020/106764 | 5/2020 |
| WO | WO2021/067166 | 4/2021 |

OTHER PUBLICATIONS

International Search Report and Written Opinion, dated Aug. 4, 2020, from corresponding International Patent App. No. PCT/US2020/026443.

"International Alloy Designations and Chemical Composition Limits for Wrought Aluminum and Wrought Aluminum Alloys" Teal Sheets, Jan. 2015, Aluminum Association.

Rioja, R., "Fabrication methods to manufacture isotopic Al—Li alloys and products for space and aerospace applications" Materials Science and Engineering A257 (1998) 100-107.

* cited by examiner

Etched t/4 micrograph after SHT at 50X

Etched t/4 micrograph after SHT at 50X

725°F Furnace set temperature
with 715°F start soak

675°F Furnace set temperature
with 665°F start soak

875°F furnace set temperature
with 865°F start soak

775°F furnace set temperature
with 765°F start soak

Etched t/4 micrograph after SHT at 50X

Etched t/4 micrograph after SHT at 50X

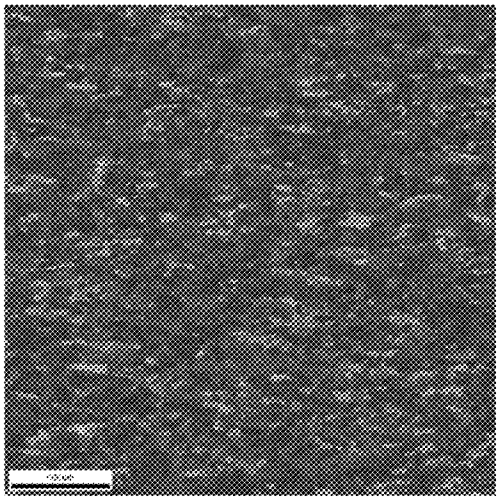
FIG. 13a (100μm scale)
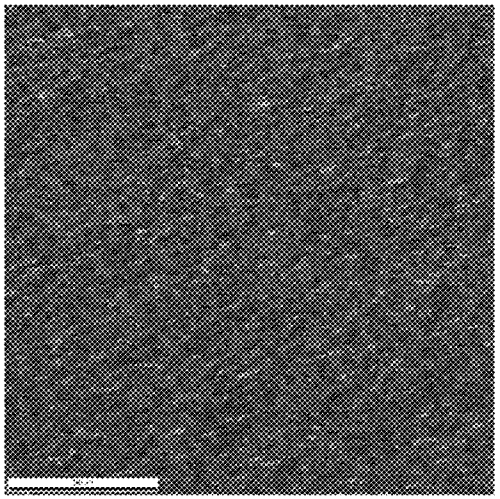
FIG. 13b (100μm scale)
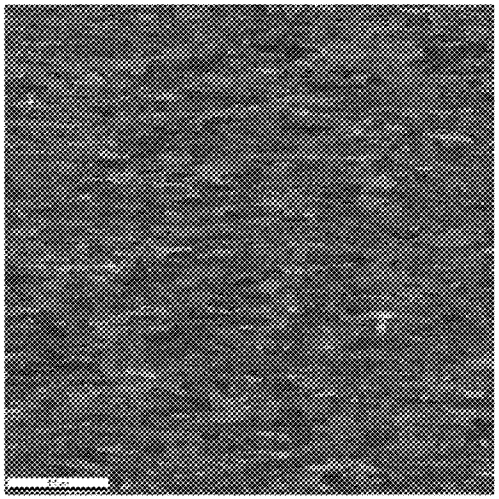
FIG. 13c (200μm scale)
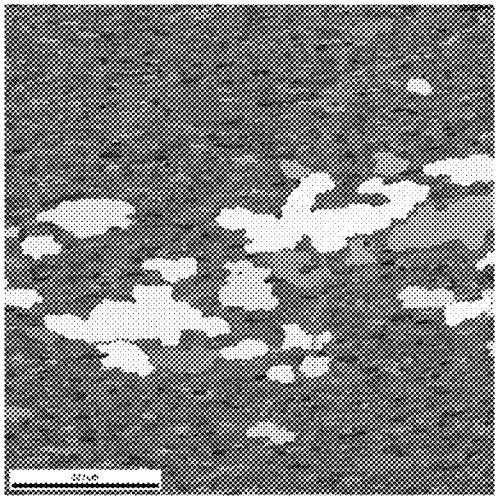
FIG. 13d (200μm scale)

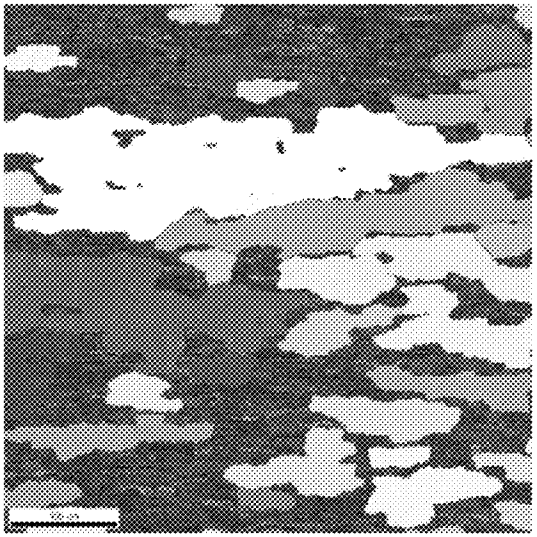
FIG. 13e (500μm scale)

FIG. 13f - Grain Size vs Area Fraction
Area Fraction (%)
0.6
0.5
0.4
0.3
0.2
0.1
0
7.5
17.5
27.5
37.5
47.5
57.5
67.5+
Grain Diameter (micrometers)

Exs. 6-8 type practices

Ex. 2 type practice

METHODS OF COLD FORMING ALUMINUM LITHIUM ALLOYS

CROSS-REFERENCE TO RELATED APPLICATION

This application is a continuation of International Patent Application No. PCT/US2020/026443, filed Apr. 2, 2020, which claims benefit of priority of U.S. Patent Application No. 62/829,799, filed Apr. 5, 2019, entitled "METHODS OF COLD FORMING ALUMINUM LITHIUM ALLOYS", each of which is incorporated herein by reference in its entirety.

FIELD OF THE INVENTION

The present disclosure relates to methods of cold forming aluminum lithium alloys and unrecrystallized products made therefrom.

BACKGROUND

Aluminum-lithium alloys are known to be produced as wrought products by hot working, followed by solution heat treatment and natural or artificial aging. Forming such aluminum-lithium products into final product forms (e.g., aerospace components) without disrupting the microstructure is problematic.

SUMMARY OF THE INVENTION

Broadly, the present patent application relates to methods of producing cold formed, unrecrystallized, extruded aluminum-lithium alloy products. The new methods disclosed herein may facilitate, for instance, production of products having improved cold formed properties, such as by facilitating retention of and/or production of extruded aluminum lithium alloy product having a predominately unrecrystallized microstructure in areas of high strain. The new methods may also facilitate more efficient production of such products, such as by facilitating a restricted number of cold forming operations and/or thermal treatment operations. Accordingly, more cost-effective products may be produced, and such products may realize improved properties.

One embodiment of a method for producing cold formed, unrecrystallized, extruded aluminum-lithium alloy products is illustrated in FIG. 1. In the illustrated embodiment, the method (10) includes heating an unrecrystallized extruded aluminum-lithium product to a treatment temperature (100), cooling the unrecrystallized extruded aluminum-lithium product from the treatment temperature to a post-treatment temperature (200), and then cold forming the unrecrystallized extruded aluminum-lithium product into a second unrecrystallized product form (300). The cold forming (300) generally plastically deforms the unrecrystallized extruded aluminum-lithium product by (A) non-uniformly deforming the unrecrystallized extruded aluminum-lithium product (e.g., such that variable strain is realized in the cold formed product), or (B) applying curvature to the unrecrystallized extruded aluminum-lithium product, thereby realizing a second product form with at least one arcuate surface, or both (A) and (B). Non-limiting examples of types of cold forming include cold stretch forming, non-uniform cold rolling, and bump forming, to name a few. More specific embodiments relating to each of these steps is provided below. As also described below, steps (100)-(300) may be repeated as many times as needed until the final version of the product is realized. In one embodiment, at least two sequences are utilized (i.e., at least two sequences of steps (100)-(300) are employed). In one embodiment, a final sequence includes a final heating step (100*f*), a final cooling step (200*f*), and a final cold forming step (300*f*). As one non-limiting example, steps (100)-(300) may be repeated up to six times, wherein the final product is obtained after the final cold forming step (300*f*). Non-limiting examples of cold formed, unrecrystallized, extruded aluminum-lithium final products include fuselage frames, fuselage stringers, fuselage skins, wing stringers, wing spars, winglets, chords, and keel beams, among others.

i. Unrecrystallized Extruded Aluminum-Lithium Products

Referring now to FIG. 2*a*, as noted above, the heating step (100) may include heating an unrecrystallized extruded aluminum-lithium product. Prior to the heating (100), an unrecrystallized extrusion (extruded product) is produced. The unrecrystallized extruded aluminum-lithium product may be made as an extrusion via any suitable direct or indirect extrusion technique (110). In one embodiment, the unrecrystallized extruded aluminum-lithium product is produced by indirect extrusion. In another embodiment, the unrecrystallized extruded aluminum-lithium product is produced by direct extrusion. Generally, prior to the heating (100), an unrecrystallized extruded aluminum-lithium product is predominately unrecrystallized, i.e., contains more than 50% unrecrystallized grains. In one embodiment, prior to the heating (100), an unrecrystallized extruded aluminum-lithium product is at least 60% unrecrystallized. In another embodiment, prior to the heating (100), an unrecrystallized extruded aluminum-lithium product is at least 70% unrecrystallized. In yet another embodiment, prior to the heating (100), an unrecrystallized extruded aluminum-lithium product is at least 80% unrecrystallized. In another embodiment, prior to the heating (100), an unrecrystallized extruded aluminum-lithium product is at least 90% unrecrystallized. In yet another embodiment, prior to the heating (100), an unrecrystallized extruded aluminum-lithium product is at least 95% unrecrystallized, or more. Whether a product is unrecrystallized may be determined by visual inspection of appropriate optical micrographs, or via an EBSD analysis, as described in further detail below.

The unrecrystallized extruded aluminum-lithium product may be made from any suitable aluminum alloy having lithium. In one embodiment, an aluminum-lithium alloy comprises from 0.2 to 5.0 wt. % Li (120). In one embodiment, the aluminum-lithium alloy is one of a 2xxx, 5xxx, 7xxx, or 8xxx aluminum alloy having lithium (130). Definitions of 2xxx, 5xxx, 7xxx, and 8xxx aluminum alloy products are per the document "International Alloy Designations and Chemical Composition Limits for Wrought Aluminum and Wrought Aluminum Alloys," January 2015, published by the Aluminum Association, a.k.a. "the Teal Sheets." In one embodiment, the aluminum-lithium alloy is a 2xxx-Li alloy, i.e., a 2xxx aluminum alloy having lithium. In another embodiment, the aluminum-lithium alloy is a 5xxx-Li alloy, i.e., a 5xxx aluminum alloy having lithium. In another embodiment, the aluminum-lithium alloy is a 8xxx-Li alloy, i.e., a 8xxx aluminum alloy having lithium.

In one embodiment, the unrecrystallized extruded aluminum-lithium product is a 2xxx-Li product. In one embodiment, a 2xxx-Li product comprises from 2.0-5.0 wt. % Cu, 0.2-2.0 wt. % Li, up to 1.5 wt. % Mg, up to 1.0 wt. % Ag, up to 1.0 wt. % Mn, up to 1.5 wt. % Zn, up to 0.25 wt. % each of Zr, Ti, Sc, and Hf, the balance being aluminum, optional incidental elements, and impurities. In one embodiment, a 2xxx-Li product is a 2×55-style aluminum alloy product having 3.2-4.2 wt. % Cu, 0.10-0.50 wt. % Mn, 0.20-0.6 wt. % Mg, 0.30-0.7 wt. % Zn, 0.20-0.7 wt. % Ag, 1.0-1.3 wt. % Li, 0.05-0.15 wt. % Zr, up to 0.10 wt. % Ti, up to 0.10 wt. % Fe, and up to 0.07 wt. % Si, the balance being aluminum, optional incidental elements, and impurities.

ii. Heating Step

Referring now to FIG. 2*b*, as noted above, the heating step (100) may include heating an unrecrystallized extruded aluminum-lithium product to a treatment temperature (100). Generally, this treatment temperature is at least 750° F. The particular treatment temperature used may depend on alloy composition, but the treatment temperature is generally below the solidus temperature of the particular aluminum-lithium alloy being employed. In one embodiment, the treatment temperature is from 85° F. below a solidus temperature of the unrecrystallized extruded aluminum-lithium product to 15° F. below a solidus temperature of the unrecrystallized extruded aluminum-lithium product (140). As shown by data included herein, shown below, using high thermal treatment temperatures in combination with appropriate cooling steps (200) and appropriate cold forming steps (300) may facilitate production of cold formed unrecrystallized extruded aluminum-lithium products. In one embodiment, the thermal treatment temperature is at least 800° F. In another embodiment, the thermal treatment temperature is at least 850° F. In yet another embodiment, the thermal treatment temperature is at least 900° F. In another embodiment, the thermal treatment temperature is at least 925° F. Other treatment temperatures may be used.

To reach the treatment temperature, the product heat-up rate should be suitably high. The product heat-up rate is the amount of time it takes the product (as a whole) to be within 10° F. of the treatment temperature. Thermocouples may be used to determine when a product has reached the treatment temperature. For instance, if it takes 43 minutes for a product (as a whole) to go from a temperature of 75° F. to a treatment temperature of 925° F., the heat-up rate would be 19.76° F. per minute ((925° F.−75° F.)/43 minutes=19.76° F. per minute).

In one embodiment, the heat-up rate is at least 1° F. per minute (150). In another embodiment, the heat-up rate is at least 3° F. per minute. In yet another embodiment, the heat-up rate is at least 5° F. per minute. In another embodiment, the heat-up rate is at least 8° F. per minute. In yet another embodiment, the heat-up rate is at least 10° F. per minute. In another embodiment, the heat-up rate is at least 15° F. per minute. In yet another embodiment, the heat-up rate is at least 20° F. per minute. In another embodiment, the heat-up rate is at least 25° F. per minute. In yet another embodiment, the heat-up rate is at least 35° F. per minute. In another embodiment, the heat-up rate is at least 45° F. per minute. In yet another embodiment, the heat-up rate is at least 55° F. per minute. In another embodiment, the heat-up rate is at least 65° F. per minute. In yet another embodiment, the heat-up rate is at least 75° F. per minute. In another embodiment, the heat-up rate is at least 85° F. per minute. In one embodiment, the heat-up rate is not greater than 100° F. per minute (155).

Once the product has reached the treatment temperature, it may be held at the treatment temperature for any suitable amount of time. In one embodiment, the product is held for a time sufficient to dissolve at least some precipitate phase particles. In another embodiment, the product is held for a time sufficient to dissolve a majority of, or nearly all, precipitate phase particles. Non-limiting examples of precipitate phase particles that may be dissolved in the aluminum-lithium alloy product include $Al_2CuLi$ (T1), $Al_3Li$ (delta prime), $Al_2Cu$ (theta prime), AlLi (delta), $Al_2CuMg$ (S prime) and $Al_2Cu$ (omega), among others. In one embodiment, the holding time at the treatment temperature is at least 5 minutes. In another embodiment, the holding time is at least 30 minutes. In one embodiment, the holding time is not greater than 10 hours. In another embodiment, the holding time is not greater than 5 hours. In another embodiment, the holding time is not greater than 3 hours. In another embodiment, the holding time is not greater than 2 hours. In one particular embodiment, the holding time is about 1 hour. Thus, the heating step (100) may comprises holding the unrecrystallized extruded aluminum-lithium product at the treatment temperature for a period of time sufficient to dissolve a predominate amount of precipitate phase particles but without recrystallizing the unrecrystallized extruded aluminum-lithium product.

Referring now to FIG. 2*c*, the final heating step (100*f*) may employ any of the heating conditions/parameters described in this section. In some instances, the final heating step (100*f*) is considered a solution heat treatment step, as shown in FIG. 2*c*.

iii. Cooling Step

Referring now to FIG. 3, as noted above, the cooling step (200) may include cooling the unrecrystallized extruded aluminum-lithium product from the treatment temperature to a post-treatment temperature. For non-final cooling steps, the cooling rate from the treatment temperature to the post-treatment temperature is generally not greater than 500° F./minute. By using appropriate cooling rates, an appropriate amount of and/or an appropriate distribution of precipitates may form in the unrecrystallized extruded aluminum-lithium product. This distribution may facilitate, for instance, higher concentrations of smaller precipitate phase particles, as explained in further detail below. Higher concentrations of smaller precipitate phase particles (e.g., within the D10, D50, and D90 amounts described in Section iv, below) may facilitate grain boundary pinning while also reducing the amount of solute present during cold forming operations. The grain boundary pinning may restrict/prevent recrystallization. Further having a relatively low amount of nano-scale precipitate phases (e.g., <20 nanometers), which commonly act as a strengthening phase, may facilitate working of the material. Larger particles may also act as nucleation sites for recrystallization. Accordingly, the methods described herein may restrict/avoid the production of large scale and nano-scale particles, while having an appropriate amount of small precipitate phase particles.

As noted above, in one embodiment, the cooling rate from the treatment temperature to the post-treatment temperature is not greater than 500° F./minute. For instance, if a material was cooled from a treatment temperature of 965° F. to a post-treatment temperature of 75° F. in 118 minutes, the cooling rate would be 7.5° F. per minute. In one embodiment, the cooling rate is not greater than 400° F. per minute. In another embodiment, the cooling rate is not greater than 300° F. per minute. In yet another embodiment, the cooling rate is not greater than 200° F. per minute. In another embodiment, the cooling rate is not greater than 100° F. per minute. In yet another embodiment, the cooling rate is not greater than 50° F. per minute, or less.

The cooling rate should also be sufficiently fast to restrict production of large precipitate phase particles. Thus, in one embodiment, the cooling rate is at least 1° F. per minute. Accordingly, one acceptable cooling rate range may be a cooling rate of from at least 1° F. per minute to not greater than 500° F. per minute (210). In one embodiment, the cooling rate is at least 5° F. per minute. In another embodiment, the cooling rate is at least 10° F. per minute.

In one embodiment, the cooling step (200) comprises air cooling (215). In one embodiment, the air cooling (215) comprises removing the product from a furnace (or other heating apparatus) and allowing the product to naturally cool to room temperature. In another embodiment, the air cooling comprises forced air cooling, wherein the product is removed from a furnace (or other heating apparatus) and air (or another gas) is forced around the outer surface of the product, facilitating convective cooling.

After conclusion of the cooling step (200), the unrecrystallized extruded aluminum-lithium product may wholly or partially maintain its unrecrystallized microstructure (220) and due to, at least in part, use of the processing conditions described herein. Generally, after conclusion of the cooling step (200), the unrecrystallized extruded aluminum-lithium product is predominately unrecrystallized. In one embodiment, after conclusion of the cooling step (200), the unrecrystallized extruded aluminum-lithium product is at least 60% unrecrystallized. In another embodiment, after conclusion of the cooling step (200), the unrecrystallized extruded aluminum-lithium product is at least 70% unrecrystallized. In yet another embodiment, after conclusion of the cooling step (200), the unrecrystallized extruded aluminum-lithium product is at least 80% unrecrystallized. In another embodiment, after conclusion of the cooling step (200), the unrecrystallized extruded aluminum-lithium product is at least 90% unrecrystallized. In yet another embodiment, after conclusion of the cooling step (200), the unrecrystallized extruded aluminum-lithium product is at least 95% unrecrystallized, or more.

Referring now to FIG. 2*c*, the final cooling step (200*f*) follows the final heating step (100*f*). For the final cooling step (200*f*), the cooling rate is generally different. Specifically, the final cooling step may employ a rapid quench to form a supersaturated state (e.g., for subsequent natural or artificial aging). In some embodiments, the final cooling step (200*f*) is considered a rapid quenching step relative to a solution heat treatment, as shown in FIG. 2*c*. Thus, in some embodiments, the cooling rates for the final cooling step (200*f*) may be 1000° F. per minute, or higher. Some suitable rapid quenching methods include liquid immersion and liquid spraying, such as cold-water immersion or cold-water spraying, among others. In one embodiment, the cooling rate of the final cooling step (200*f*) is at least 100° F. per second. In another embodiment, the cooling rate of the final cooling step (200*f*) is at least 200° F. per second. In yet another embodiment, the cooling rate of the final cooling step (200*f*) is at least 400° F. per second. In another embodiment, the cooling rate of the final cooling step (200*f*) is at least 800° F. per second. In yet another embodiment, the cooling rate of the final cooling step (200*f*) is at least 1600° F. per second, or higher.

iv. Cold Forming Step

Referring now to FIG. 4*a*, as noted above, the cold forming step (300) may include cold forming the unrecrystallized extruded aluminum-lithium product into a second unrecrystallized product form (300). The cold forming (300) generally plastically deforms the unrecrystallized extruded aluminum-lithium product by (A) non-uniformly deforming the unrecrystallized extruded aluminum-lithium product (e.g., such that variable strain is realized in the cold formed product) (320), or (B) applying curvature to the unrecrystallized extruded aluminum-lithium product (330), thereby realizing a second product form with at least one arcuate surface, or both (A) and (B). Non-limiting examples of types of cold forming include cold stretch forming, non-uniform cold rolling, and bump forming, to name a few. For purposes of this patent application, the non-final cold forming step (300) does not include cold rolling that generally uniformly strains the product, such as conventional cold rolling of sheet or plate.

In one embodiment, a non-final cold forming step induces 3-20% strain in at least portions of the product (310). Higher strain amounts may facilitate fewer cold forming cycles. However, too much strain may result in recrystallizing minor portions or even significant portions of the product. Thus, the induced strain should be controlled. In one embodiment, the maximum induced strain of a non-final cold forming step is not greater than 18%. In another embodiment, the maximum induced strain of a non-final cold forming step is not greater than 15%. In yet another embodiment, the maximum induced strain of a non-final cold forming step is not greater than 12%. In another embodiment, the maximum induced strain of a non-final cold forming step is not greater than 10%. In yet another embodiment, the maximum induced strain of a non-final cold forming step is not greater than 8%, or less. In one embodiment, the maximum induced strain of a non-final cold forming step is at least 3.5%. In another embodiment, the maximum induced strain of a non-final cold forming step is at least 4%. In yet another embodiment, the maximum induced strain of a non-final cold forming step is at least 4.5%. In another embodiment, the maximum induced strain of a non-final cold forming step is at least 5%. In yet another embodiment, the maximum induced strain of a non-final cold forming step is at least 5.5%, or more.

As noted above, the cold forming (300) may comprise non-uniformly deforming the unrecrystallized extruded aluminum-lithium product (320). In one embodiment, the cold forming (300) results in a first portion (322) of the second product form realizing a first strain amount and a second portion (324) of the second product form realizing a second strain amount, wherein the first strain amount is at least 1% different than the second strain amount (326). In one embodiment, the difference in strain is at least 2%. In another embodiment, the difference in strain is at least 3%. In another embodiment, the difference in strain is at least 5%. In another embodiment, the difference in strain is at least 6%, or higher.

The cold forming (300) may be initiated at any suitable cold forming temperature. Generally, cold forming is initiated when products will be strain hardened, mainly through dislocation glide processes and dislocation interactions, resulting in dislocation multiplication and an overall increase in dislocation density in the metal. Accordingly, in one embodiment, the cold forming step (300) is initiated when the unrecrystallized extruded aluminum-lithium product has a temperature of not greater than 400° F. In another embodiment, the cold forming step (300) is initiated when the unrecrystallized extruded aluminum-lithium product has a temperature of not greater than 300° F. In yet another embodiment, the cold forming step (300) is initiated when the unrecrystallized extruded aluminum-lithium product has a temperature of not greater than 200° F. In another embodiment, the cold forming step (300) is initiated when the unrecrystallized extruded aluminum-lithium product has a temperature of not greater than 150° F. In yet another embodiment, the cold forming step (300) is initiated when the unrecrystallized extruded aluminum-lithium product has a temperature of not greater than 125° F. In another embodiment, the cold forming step (300) is initiated when the unrecrystallized extruded aluminum-lithium product has a temperature of not greater than 100° F. In yet another embodiment, the cold forming step (300) is initiated when the unrecrystallized extruded aluminum-lithium product has a temperature of not greater than 90° F., or less. In one embodiment, the cold forming step (300) is initiated when the unrecrystallized extruded aluminum-lithium product is at ambient temperature.

After conclusion of the cold forming step (300), the second product form may wholly or partially maintain the unrecrystallized microstructure (340) of the prior unrecrystallized extruded aluminum-lithium product, and due to, at least in part, use of the processing conditions described herein. Generally, after conclusion of the cold forming step (300), the second product is predominately unrecrystallized. In one embodiment, after conclusion of the cold forming step (300), the second product form is at least 60% unrecrystallized. In another embodiment, after conclusion of the cold forming step (300), the second product form is at least 70% unrecrystallized. In yet another embodiment, after conclusion of the cold forming step (300), the second product form is at least 80% unrecrystallized. In another embodiment, after conclusion of the cold forming step (300), the second product form is at least 90% unrecrystallized. In yet another embodiment, after conclusion of the cold forming step (300), the second product form is at least 95% unrecrystallized, or more.

Referring now to FIG. 4*b*, as noted above, due to the processing conditions disclosed herein, a unique distribution of precipitate phase particles may be realized. This distribution may facilitate, for instance, higher concentration of smaller precipitate phase particles (350), as explained in Section iii, above. In one embodiment, the second product form comprises precipitate phase particles and the D50 of these precipitate phase particles is not greater than 0.50 micrometers. In another embodiment, the D50 of these precipitate phase particles is not greater than 0.25 micrometers. In yet another embodiment, the D50 of these precipitate phase particles is not greater than 0.10 micrometers. In another embodiment, the D50 of these precipitate phase particles is not greater than 0.08 micrometers, or less. Particle sizes and their distribution are to be measured and calculated in accordance with the Particle Size Computer Analysis Procedure, below. The initial unrecrystallized extruded aluminum-lithium product may also realize any of these precipitate phase particles sizes and particle size distributions.

In one embodiment, the second product form comprises precipitate phase particles and the D90 of these precipitate phase particles is not greater than 2.0 micrometers. In another embodiment, the D90 of these precipitate phase particles is not greater than 1.5 micrometers. In yet another embodiment, the D90 of these precipitate phase particles is not greater than 1.25 micrometers. In another embodiment, the D90 of these precipitate phase particles is not greater than 1.10 micrometers, or less. The initial unrecrystallized extruded aluminum-lithium product may also realize any of these precipitate phase particles sizes and particle size distributions.

In one embodiment, the second product form comprises precipitate phase particles and the D10 of these precipitate phase particles is not greater than 0.125 micrometers. In another embodiment, the D10 of these precipitate phase particles is not greater than 0.10 micrometers. In yet another embodiment, the D10 of these precipitate phase particles is not greater than 0.075 micrometers. In another embodiment, the D10 of these precipitate phase particles is not greater than 0.050 micrometers. In yet another embodiment, the D10 of these precipitate phase particles is not greater than 0.025 micrometers, or less. The initial unrecrystallized extruded aluminum-lithium product may also realize any of these precipitate phase particles sizes and particle size distributions.

Referring now to FIG. 2*c*, the final cold forming step (300*f*) follows the final cooling step (200*f*). The final cold forming step may induce 0.5 to 20% or 0.5-10% strain in at least portions of the product. In one embodiment, the maximum induced strain of the final cold forming step is not greater than 8%. In another embodiment, the maximum induced strain of the final cold forming step is not greater than 6%. In yet another embodiment, the maximum induced strain of the final cold forming step is not greater than 5%, or less. In one embodiment, the maximum induced strain of the final cold forming step is at least 1.0%. In another embodiment, the maximum induced strain of the final cold forming step is at least 1.5%. In yet another embodiment, the maximum induced strain of the final cold forming step is at least 2.0%. In another embodiment, the maximum induced strain of the final cold forming step is at least 2.5%. In yet another embodiment, the maximum induced strain of the final cold forming step is at least 3.5%, or more. In one embodiment, the final cold forming step (300*f*) may employ any of the cold forming operations described above. In another embodiment, the final cold forming step (300*f*) is a cold working step comprising one or more of stretching and rolling, among other things. In one embodiment, the final cold forming step (300*f*) is stretching. In another embodiment, the final cold forming step (300*f*) is rolling. Unlike non-final cold forming operations, in some instances, the final cold forming step (300*f*) may include uniform strain and/or non-arcuate straining (e.g., generally uniform stretching). In one embodiment, the final cold forming step comprises stretching of the product by about 1-5%.

v. Repeating of Steps

Still referring to FIG. 2*c*, as noted above, steps (100)-(300) may be repeated as many times as needed until the final version of the product is realized. In one embodiment, at least two cycles are employed, an initial cycle ($\mathbf{100}_i$)-($\mathbf{300}_i$) and a final cycle ($\mathbf{100}_f$)-($\mathbf{300}_f$). Any number of intermediate cycles may be employed. Thus, the second product form may not be the final product form, i.e., the second product form may be an intermediate product form. In these embodiments, the second product form may be processed as per steps (100)-(300) to produce another product form. When the second product form is to be processed to another intermediate product form, the non-final versions of the heating (100), cooling (200) and cold forming (300) steps are employed. When the second product form is to be processed to the final product form, the final versions of the heating (100*f*), cooling (200*f*), and cold forming (300*f*) steps are employed. Thus, the method may repeat the heating, cooling, and cold forming steps as many times as need until the final product form is realized. In one embodiment, steps (100)-(300) are repeated six times. In another embodiment, steps (100)-(300) are repeated five times. In yet another embodiment, steps (100)-(300) are repeated four times. In another embodiment, steps (100)-(300) are repeated three times. In another embodiment, steps (100)-(300) are repeated only two times, e.g., steps (100*i*)-(300*i*) are conducted followed by steps (100*f*)-(300*f*).

Irrespective of the number of times steps (100)-(300) are conducted, the final product form may realize a predominately unrecrystallized microstructure. In one embodiment, the final product form is at least 60% unrecrystallized. In another embodiment, the final product form is at least 70% unrecrystallized. In yet another embodiment, the final product form is at least 80% unrecrystallized. In another embodiment, the final product form is at least 90% unrecrystallized. In yet another embodiment, the final product form is at least 95% unrecrystallized, or more.

As noted above, the final product may be used in a variety of aerospace and other applications. Non-limiting examples of cold formed, unrecrystallized, extruded aluminum-lithium final products useful in aerospace applications include fuselage frames, fuselage stringers, fuselage skins, wing stringers, wing spars, winglets, chords, and keel beams, among others. The final products may also be used in other applications, such as in automotive, ground transportation, and industrial applications, for instance.

Finally, it is noted that steps (100), (200) and (300) have inventive merit on their own. For instance, it is believed that step (100) is novel and inventive and may patentably stand on its own. It is believed that step (200) is novel and inventive and may patentably stand on its own. It is believed that step (300) is novel and inventive and may patentably stand on its own. The same applies to final steps (100*f*), (200*f*), and (300*f*).

vi. Optional Additional Processing of the Final Product

Referring now to FIG. 5*a*, after the final cold forming step (300*f*), the final product may optionally be subject to one or more additional processing operations. For instance, the final product may be aged (410) or machined (420). The aging step (410) may include natural (412) and/or artificial (414) aging. Thus, the final product is typically in one of a T3, T4, T6, T7, or T8 temper. If other processing is used, the final product may be in other tempers, such as any of the T1, T2, T5, T9 or T10 tempers. The final product may also be supplied in the W temper. Temper designations used herein are per ANSI H35.1 (2009).

Referring now to FIG. 5*b*, after any optional additional processing (400), the post-processed final product form may wholly or partially maintain an unrecrystallized microstructure (460). Thus, the post-processed final product form may realize a predominately unrecrystallized microstructure. In one embodiment, the final product form is at least 60% unrecrystallized. In another embodiment, the final product form is at least 70% unrecrystallized. In yet another embodiment, the final product form is at least 80% unrecrystallized. In another embodiment, the final product form is at least 90% unrecrystallized. In yet another embodiment, the final product form is at least 95% unrecrystallized, or more.

As noted above, the final product may be used in a variety of aerospace and other applications. Non-limiting examples of cold formed, unrecrystallized, extruded aluminum-lithium final products useful in aerospace applications include fuselage frames, fuselage stringers, fuselage skins, wing stringers, wing spars, winglets, chords, and keel beams, among others.

vii. Application to Other Alloys and Product Forms

Although the methods described in the preceding sections were described relative to aluminum-lithium alloy products (e.g., a 2xxx-Li product; a 5xxx-Li product; a 8xxx-Li product), the methods described herein may also find utility with other heat treatable aluminum alloys, such as with any of the lithium-free versions of the 2xxx, 6xxx, 7xxx, and heat treatable 8xxx aluminum alloys, and it is expressly contemplated that the inventive methods described herein may have utility with such aluminum alloys. Further, although the methods described in the preceding sections were described relative to extruded aluminum alloy products, the methods described herein may also find utility with other wrought product forms, such as unrecrystallized rolled aluminum alloy products and unrecrystallized forged aluminum alloy products, and it is it is expressly contemplated that the inventive methods described herein may have utility with such unrecrystallized rolled aluminum alloy products and such unrecrystallized forged aluminum alloy products.

viii. Procedures

A. Microstructure Determination Procedure

The below procedure is to be used to determine whether one or more cold formed portions of an extruded aluminum alloy product made in accordance with the present patent application are recrystallized or an unrecrystallized. A similar analysis may be done to determine the degree of recrystallization of a product.

Step 1—Obtain Three Specimens from Area with Highest Cold Forming Strain

Three specimens from the extruded product are to be taken from the area of highest strain due to cold forming in the extruded product. Cold forming strain is the strain induced by cold forming (defined above). For instance, if the cold forming results in portions of the product having 8%, 6% and 4% strain due to cold forming, the three specimens would be taken from the portion have the 8% strain due to cold forming. Other strain within the extruded product (e.g., induced by the extrusion process) is to be disregarded. Only the cold forming strain is to be considered. Strain may be measured using various known methods such as, but not limited to the following: gage marks, strain gauges and digital speckle pattern correlation.

Step 2—Prepare Optical Micrographs of the Three Specimens

Optical micrographs of the three specimens obtained in Step 1 are to be obtained. First, the samples are to be prepared by standard metallographic sample preparation methods. For example, the samples may be polished with Buehler Si—C paper by hand for 3 minutes, followed by polishing by hand with a Buehler diamond liquid polish having an average particle size of about 3 microns. The samples may then be anodized in an aqueous fluoric-boric solution for 30-45 seconds. The samples may then be stripped using an aqueous phosphoric acid solution containing chromium trioxide, and then rinsed and dried. These procedures are in accordance with ASTM E3, Standard Guide for Preparation of Metallographic Specimens.

After preparation, optical micrographs of each of the three samples in the LT-ST plane are to be obtained at either 50× or 100× magnification. The optical micrographs are to show the entire thickness of the sample. One example of a suitable optical micrograph of an invention alloy is shown in FIG. 15*a*. An example of a suitable optical micrograph of a non-invention alloy is shown in FIG. 15*b*. As shown, the invention alloy is generally unrecrystallized in inner regions 1020, which regions, in this particular case, are generally from about 10% below the surface to just outside the middle portions (T/2) of the product. Conversely, the non-invention alloy is recrystallized in this same region (1040). Further, the inventive product is nearly fully unrecrystallized, only realizing a few large grains at the mid-thickness portion of the product. Thus, in one embodiment, visual inspection of optical micrographs will indicate whether cold formed portions of an extruded aluminum alloy product are unrecrystallized (as per FIG. 15*a*) or are recrystallized (as per FIG. 15*b*). As may be appreciated, if the high strain portions of the extruded aluminum alloy product remain unrecrystallized, then the other portions of an unrecrystallized extruded aluminum alloy product also will generally remain unrecrystallized due to thermodynamics.

Step 3 (Optional)—Prepare EBSD Images and Obtain Grain Size Data

In some embodiments, EBSD imaging and corresponding computer analysis may be used to determine whether cold formed portions of a product are unrecrystallized. In these embodiments, the specimens obtained in Step 1 and the optical micrographs from Step 2 are to be used. Using the optical micrographs from Step 2, areas with large grains are to be identified. For instance, in FIG. 15*a*, some large grains appear to be located at the mid-thickness (T/2) of the product. Next, the specific large grain area from the specimens are to be subject to EBSD (electron backscattered diffraction) using three SEM images at 1000× magnification of the large grain area. Thus, if EBSD analysis were to be done on the product of FIG. 15*a* (which would be unnecessary because the product is unrecrystallized), the EBSD analysis would be conducted by obtaining three SEM images at 1000× magnification of the large grain region of the product of FIG. 15*a*.

The obtained SEMs are to be subject to computerized analysis wherein grain sizes are calculated per the Grain Size Computer Analysis Procedure, shown below. The numerical grain size data from the three SEM is to be collated in an appropriate data analysis program (e.g., MICROSOFT EXCEL) and analyzed via a histogram analysis. The histogram shall allocate grains of less than 7.5 micrometers to the first bin, with subsequent bins being increments of 10 micrometers in grain size, up to 67.4 micrometers. The final bin shall be for grains having a size of at least 67.5 micrometers. The analysis shall calculate the number of grains per bin and determine the area fraction (%) for those bins. An example is shown in FIG. 13*f*.

B. Grain Size Computer Analysis Procedure

Electron backscatter diffraction (EBSD) mapping measurements are to be carried out using a Thermo Fisher Scientific Apreo S scanning electron microscope (SEM), or equivalent, equipped with an EBSD camera, an EDAX Hikari Super camera, or equivalent. Measurements should be undertaken using SEM imaging conditions utilizing a spot size of 16 (or equivalent), an acceleration voltage of 20 kV, with a sample tilt angle of 65° and a working distance of 17 mm. EBSD is to be performed using EDAX OIM Data Collection software version 7.3.1 in conjunction with an EDAX Hikari Super camera, or equivalent. EBSD patterns are to be collected using 4×4 binning and enhanced image processing, including static background subtraction with subsequent normalized intensity histogram), or equivalent. EBSD scans are to be carried out with dimensions of 500 μm×500 μm using a square grid scanning pattern with a step size of 0.5 μm.

The software used to analyze the acquired data should be an EDAX TSL OIM™ 8 data analysis package or similar. Data analysis is to include a 2-step clean-up procedure. The first step is a Neighbor Orientation Correlation level 2 clean up applied to data with a minimum confidence index (CI) of 0.1 and grain tolerance angle of 5 degrees. The second step is a Grain Dilation using a grain tolerance angle of 5 degrees and a minimum of 5 points per grain for a single iteration.

Grains are defined to have a minimum of 5 points per grain with a grain tolerance angle of 5 degrees. The grain sizes are determined by the area-weighted average grain size using the software. The software first calculates the individual grain area by counting the number of points within each grain and multiplying by the size of each point (step size squared). The area-weighted average is then determined by summing the individual grain sizes multiplied by their area, divided by the total area. In all cases, the grain size results represent the equivalent diameter (in micrometers) if the grain was a perfect circle in the planar view. The grain size diameters are then binned and plotted against the area fraction.

C. Particle Size Computer Analysis Procedure

Back Scatter Electron (BSE) imaging should be performed with a scanning electron microscope FEG-SEM such as a Thermo-Scientific Apreo S or equivalent. The SEM image conditions are to be a spot size of 10 (or equivalent), an accelerating voltage of 2 kV, and a working distance of 3 mm. The images are to be acquired at a magnification of 1000× (horizontal field width of 127 micrometers) using a in-lens T1 backscatter detector, or equivalent. A gamma correction of 1.5 is to be applied to help the particles stand out from the channeling contrast of the brighter grains.

Image analysis is to be carried out using three of the obtained 1000× images using an appropriate software program, such as the ImageJ software provided by the National Institute of Health, https://imagej.nih.gov/ij/. The software is to calculate the number, size, and area percent of particles based off the user inputs of 0.0413 μm/pixel, 6 minimum pixels to define a particle, and a minimum brightness threshold of from 80-100 (usually 91), or equivalent, in the range of 0 and 255, or equivalent. Using a threshold of 80-100 (usually 91), or equivalent, will facilitate detection of the small and large particles within the images to determine their amount, and, accordingly the D10, D50, and D90 of the material. (See Section iv.) The threshold of 80-100 (usually 91), or equivalent, will also avoid detection of nano-scale particles, which would inappropriately skew the small particle and large particle results.

ix. Representative Clauses

Below are some non-limiting, representative clauses that define one or more inventions. These clauses are non-limiting examples, and are not intended to restrict, and do not restrict, the inventions disclosed herein to the matters described. Indeed, any of the subject matter described in this specification may be used to define one or more inventions.

Clause 1. A method comprising:

cold forming an unrecrystallized extruded aluminum-lithium product into a second product form;

(i) wherein the unrecrystallized extruded aluminum-lithium alloy comprises from 0.2-5.0 wt. % Li;

(ii) wherein the unrecrystallized extruded aluminum-lithium product is predominately unrecrystallized;

(iii) wherein the cold forming comprising initiating the cold forming when the unrecrystallized extruded aluminum-lithium product has a temperature of not greater than 400° F.;

(iv) wherein the cold forming comprises plastically deforming the unrecrystallized extruded aluminum-lithium product, wherein the plastically deforming comprises at least one of:

(A) non-uniformly deforming the unrecrystallized extruded aluminum-lithium product, wherein, due to the non-uniform deforming, a first portion of the second product form realizes a first strain amount and a second portion of the second product form realizes a second strain amount, wherein the first strain amount is at least 1% different than the second strain amount; and (B) applying curvature to the unrecrystallized extruded aluminum-lithium product, wherein the second product form comprises at least one arcuate surface.

(v) wherein the second product form is predominately unrecrystallized.

Clause 2. The method of clause 1, wherein, prior to the cold forming step, the method comprises:

heating the unrecrystallized extruded aluminum-lithium product to a treatment temperature, wherein the treatment temperature is at least 750° F.; and then cooling the unrecrystallized extruded aluminum-lithium product from the treatment temperature to a post-treatment temperature and at a cooling rate of not greater than 500° F./minute.

Clause 3. The method of any of the preceding clauses, comprising:

second heating the second product form to a second treatment temperature, wherein the second treatment temperature is at least 750° F.;

second cooling the second product form from the second treatment temperature to a second post-treatment temperature;

second cold forming the second product form into another product form, wherein the another product form is predominately unrecrystallized.

Clause 4. The method of any of the preceding clauses, wherein the second product form is an intermediate product form, wherein the another product form is a final product form, and wherein the second cooling comprises cooling the second product form from the second treatment temperature to the second post-treatment temperature at a rate of at least 1000° F./minute.

Clause 5. The method of any of the preceding clauses, wherein the unrecrystallized extruded aluminum-lithium product is a 2xxx-Li product, and wherein the 2xxx-Li product comprises from 2.0-5.0 wt. % Cu, 0.2-2.0 wt. % Li, up to 1.5 wt. % Mg, up to 1.0 wt. % Ag, up to 1.0 wt. % Mn, up to 1.5 wt. % Zn, up to 0.25 wt. % each of Zr, Ti, Sc, and Hf, the balance being aluminum, optional incidental elements and impurities.

Clause 6. The method of clause 5, wherein the 2xxx-Li product is a 2×55 aluminum alloy product.

Clause 7. The method of any of the preceding clauses, wherein the unrecrystallized extruded aluminum-lithium product is at least 60% unrecrystallized, or at least 70% unrecrystallized, or at least 80% unrecrystallized, or at least 90% unrecrystallized, or at least 95% unrecrystallized.

Clause 8. The method of clause 1, wherein the treatment temperature is at least 800° F., or at least 850° F., or at least 900° F., or at least 925° F.

Clause 9. The method of any of the preceding clauses, wherein the treatment temperature is below a solidus temperature of the unrecrystallized extruded aluminum-lithium product.

Clause 10. The method of any of the preceding clauses, wherein the treatment temperature is from 85° F. below a solidus temperature of the unrecrystallized extruded aluminum-lithium product to 15° F. below a solidus temperature of the unrecrystallized extruded aluminum-lithium product.

Clause 11. The method of any of the preceding clauses, wherein the heating comprises heating the unrecrystallized extruded aluminum-lithium product from the pretreatment temperature to the treatment temperature at a heating rate of at least 1° F. per minute, or at least 3° F. per minute, or at least 5° F. per minute, or at least 8° F. per minute, or at least 10° F. per minute, or at least 15° F. per minute, or at least 20° F. per minute, or at least 25° F. per minute, or at least 35° F. per minute, or at least 45° F. per minute, or at least 55° F. per minute, or at least 65° F. per minute, or at least 75° F. per minute, or at least 85° F. per minute.

Clause 12. The method of any of the preceding clauses, wherein the heating comprises heating the unrecrystallized extruded aluminum-lithium product from the pretreatment temperature to the treatment temperature at a heating rate of not greater than 100° F. per minute.

Clause 13. The method of any of the preceding clauses, wherein the heating comprises holding the unrecrystallized extruded aluminum-lithium product at the treatment temperature for a period of time sufficient to dissolve a predominate amount of precipitate phase particles but without recrystallizing the unrecrystallized extruded aluminum-lithium product.

Clause 14. The method of any of the preceding clauses, wherein the cooling comprises cooling the unrecrystallized extruded aluminum-lithium product from the treatment temperature to the post-treatment temperature at a cooling rate of not greater than 400° F./minute, or at a cooling rate of not greater than 300° F./minute, or at a cooling rate of not greater than 200° F./minute, or at a cooling rate of not greater than 100° F./minute, or not greater than 50° F. per minute.

Clause 15. The method of any of the preceding clauses, wherein the cold forming comprising including from 3% to 20% strain in the second product form.

Clause 16. The method of clause 15, wherein the cold forming comprising including not greater than 18% strain, or not greater than 15% strain, or not greater than 12% strain, or not greater than 10% strain, or not greater than 8 strain in the second product form.

Clause 17. The method of any of clauses 15-16, wherein the cold forming comprising inducing at least 3.5% strain, or at least 4% strain, or at least 4.5% strain, or at least 5% strain, or at least 5.5% in the second product form.

Clause 18. The method of any of the preceding clauses, wherein the cold forming comprises initiating the cold forming when the unrecrystallized extruded aluminum-lithium product has a temperature of not greater than 300° F., or not greater than 200° F., or not greater than 150° F., or not greater than 125° F., or not greater than 100° F.

Clause 19. The method of any of the preceding clauses, wherein the cold forming comprises initiating the cold forming when the unrecrystallized extruded aluminum-lithium product is at ambient temperature.

Clause 20. The method of any of the preceding clauses, wherein the second product form is predominately unrecrystallized, or at least 60% unrecrystallized, or at least 70% unrecrystallized, or at least 80% unrecrystallized, or at least 90% unrecrystallized, or at least 95% unrecrystallized.

Clause 21. The method of any of the preceding clauses, wherein the cold forming is stretch forming.

x. Miscellaneous

These and other aspects, advantages, and novel features of this new technology are set forth in part in the description that follows and will become apparent to those skilled in the art upon examination of the following description and figures or may be learned by practicing one or more embodiments of the technology provided for by the present disclosure.

The figures constitute a part of this specification and include illustrative embodiments of the present disclosure and illustrate various objects and features thereof. In addition, any measurements, specifications and the like shown in the figures are intended to be illustrative, and not restrictive. Therefore, specific structural and functional details disclosed herein are not to be interpreted as limiting, but merely as a representative basis for teaching one skilled in the art to variously employ the present invention.

Among those benefits and improvements that have been disclosed, other objects and advantages of this invention will become apparent from the following description taken in conjunction with the accompanying figures. Detailed embodiments of the present invention are disclosed herein; however, it is to be understood that the disclosed embodiments are merely illustrative of the invention that may be embodied in various forms. In addition, each of the examples given in connection with the various embodiments of the invention is intended to be illustrative, and not restrictive.

Throughout the specification and claims, the following terms take the meanings explicitly associated herein, unless the context clearly dictates otherwise. The phrases "in one embodiment" and "in some embodiments" as used herein do not necessarily refer to the same embodiment(s), though they may. Furthermore, the phrases "in another embodiment" and "in some other embodiments" as used herein do not necessarily refer to a different embodiment, although they may. Thus, various embodiments of the invention may be readily combined, without departing from the scope or spirit of the invention.

In addition, as used herein, the term "or" is an inclusive "or" operator and is equivalent to the term "and/or," unless the context clearly dictates otherwise. The term "based on" is not exclusive and allows for being based on additional factors not described, unless the context clearly dictates otherwise. In addition, throughout the specification, the meaning of "a," "an," and "the" include plural references, unless the context clearly dictates otherwise. The meaning of "in" includes "in" and "on", unless the context clearly dictates otherwise.

While a number of embodiments of the present invention have been described, it is understood that these embodiments are illustrative only, and not restrictive, and that many modifications may become apparent to those of ordinary skill in the art. Further still, unless the context clearly requires otherwise, the various steps may be carried out in any desired order, and any applicable steps may be added and/or eliminated.

BRIEF DESCRIPTION OF THE DRAWINGS

FIG. 13*f* is a graph showing grain size distributions based on the SEM images of Example 9.

DETAILED DESCRIPTION

Figure 1:
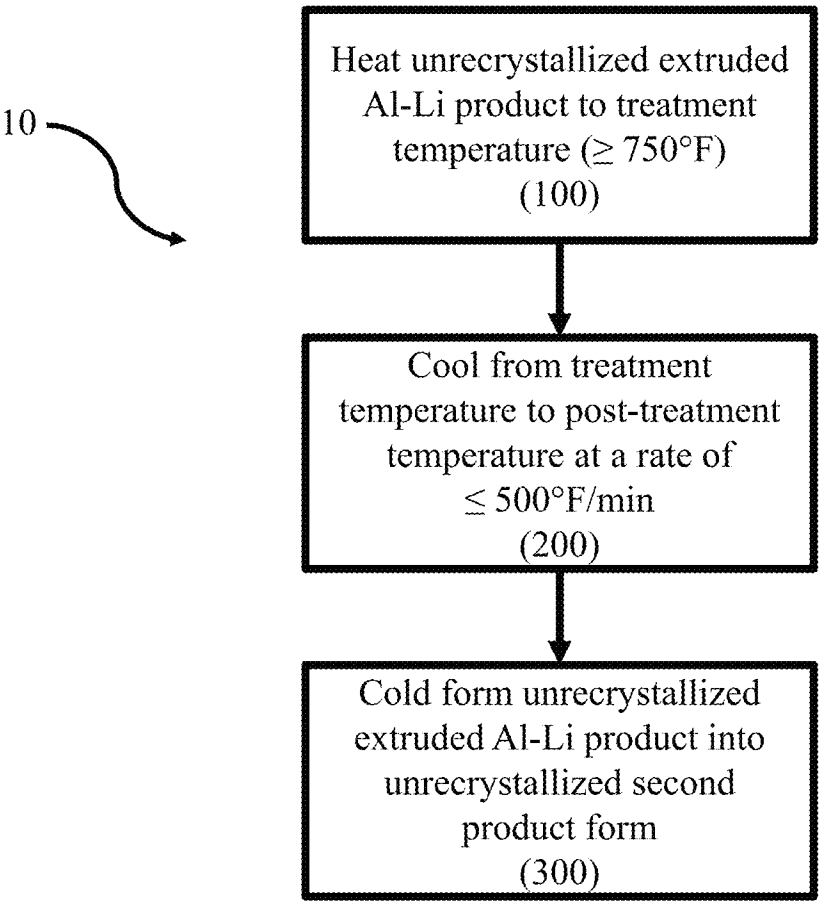
FIG. 1 is a flow chart illustrating one embodiment of an inventive method for producing unrecrystallized extruded products.
Figure 2A:
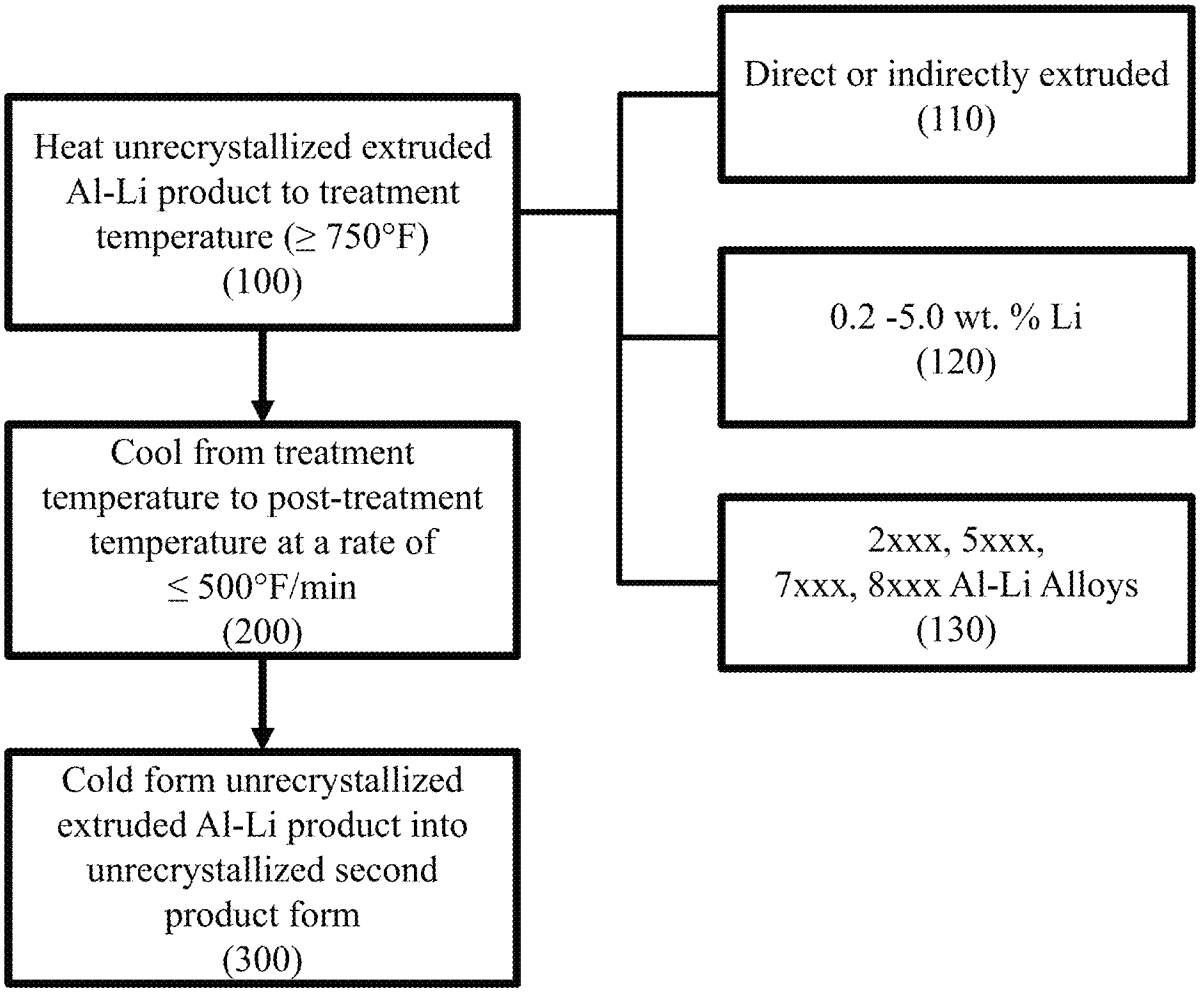
FIG. 2*a* illustrates additional embodiments of step (100) of FIG. 1 relating to aluminum alloy compositions and extruded product types.
Figure 2B:
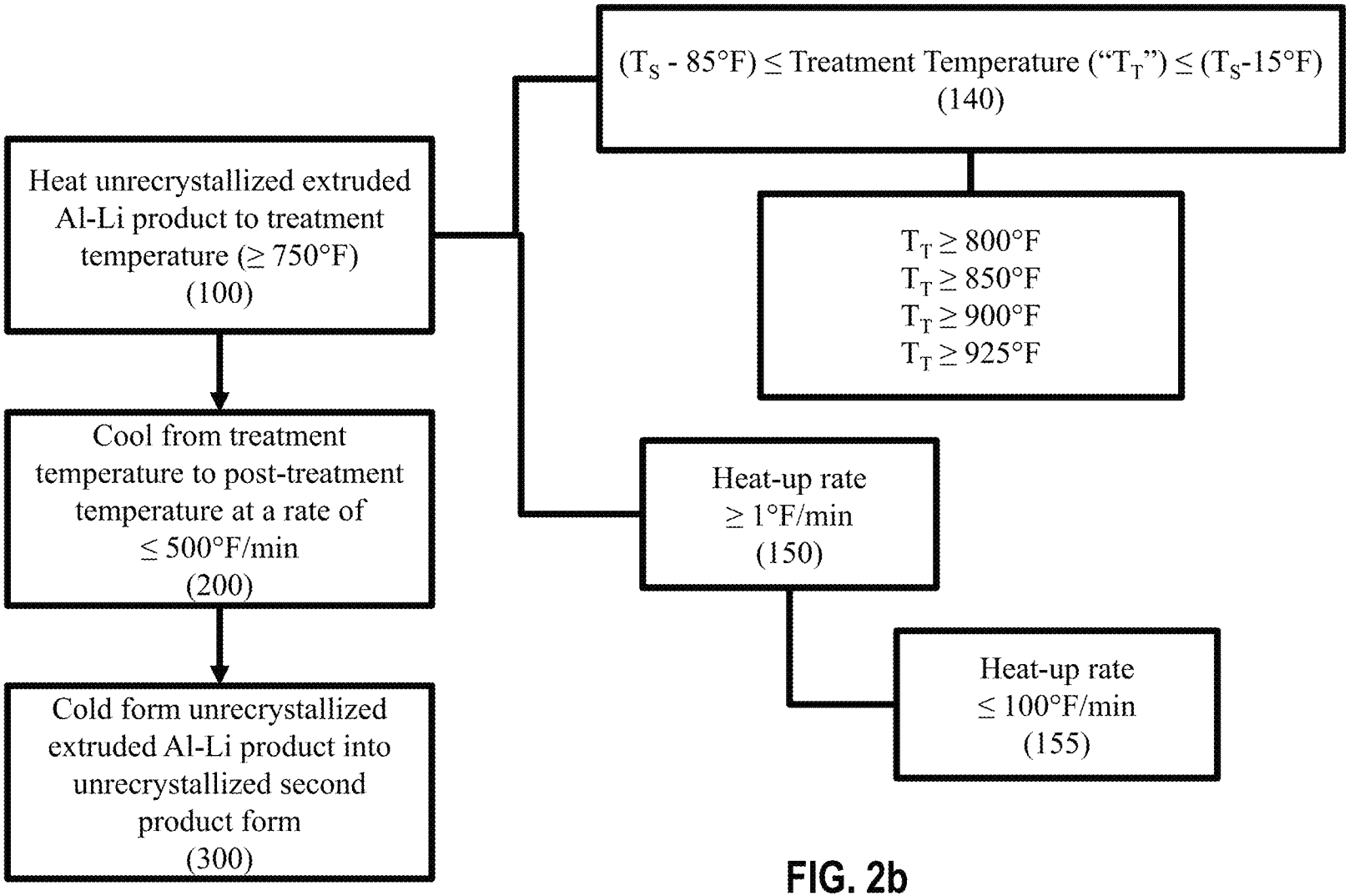
FIG. 2*b* illustrates additional embodiments of step (100) of FIG. 1 relating to thermal treatment practices.
Figure 2C:
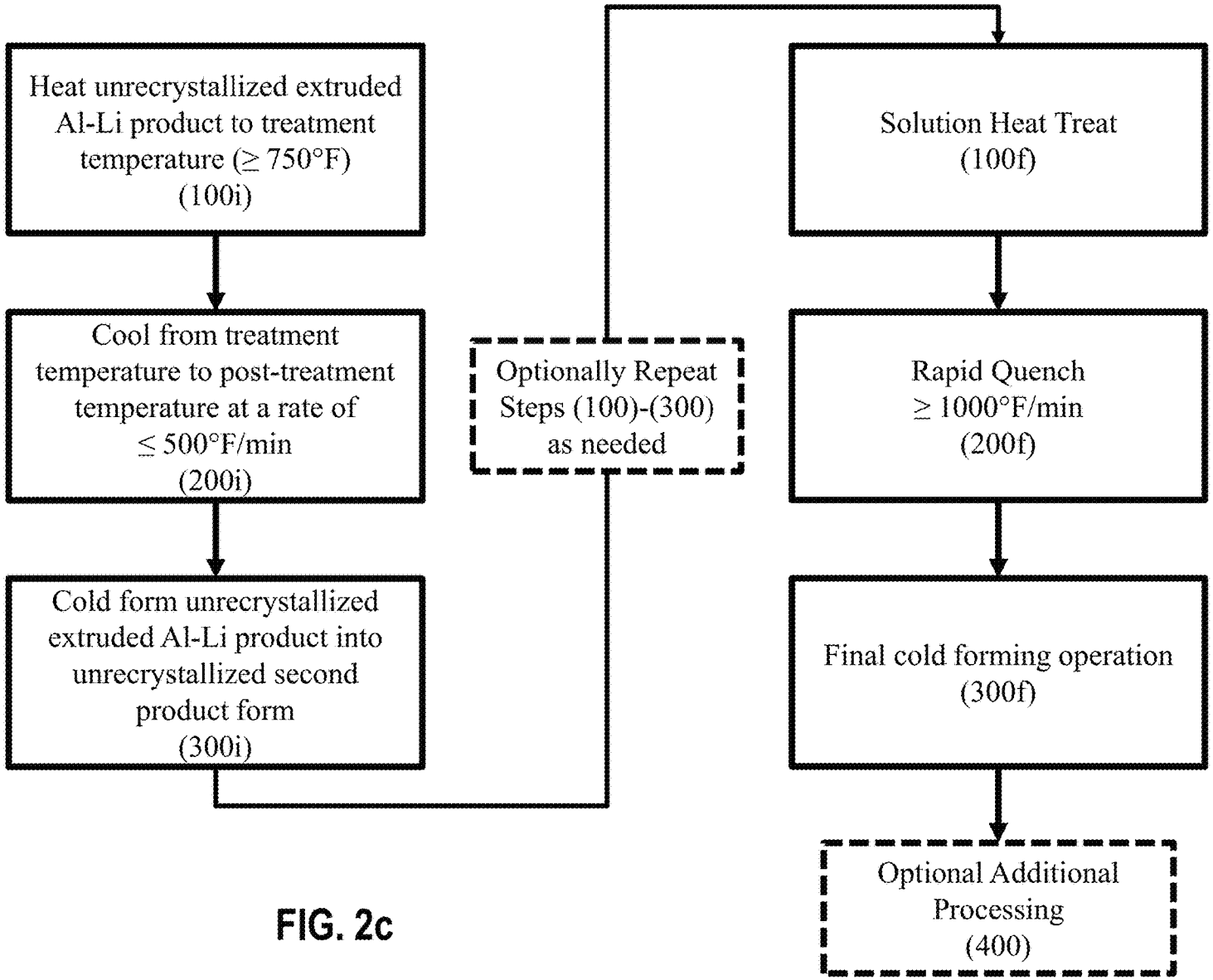
FIG. 2*c* is a flow chart illustrating cycles of the heating (100), cooling (200) and cold forming (300) steps, including the initial (100*i*-300*i*) and final (100*f*-300*f*) cycles.
Figure 3:
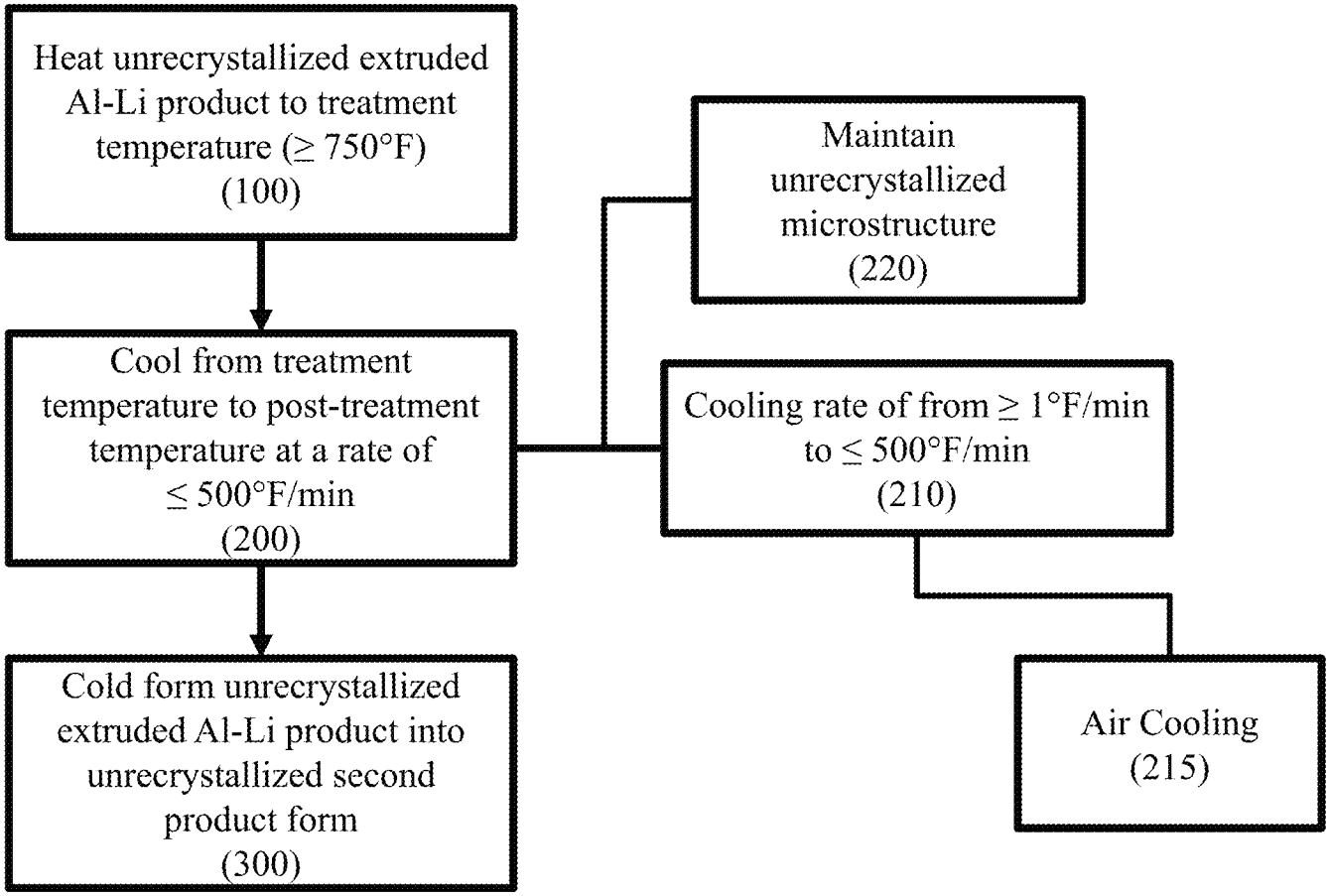
FIG. 3 illustrates additional embodiments of step (200) of FIG. 1 relating to cooling rates.
Figure 4A:
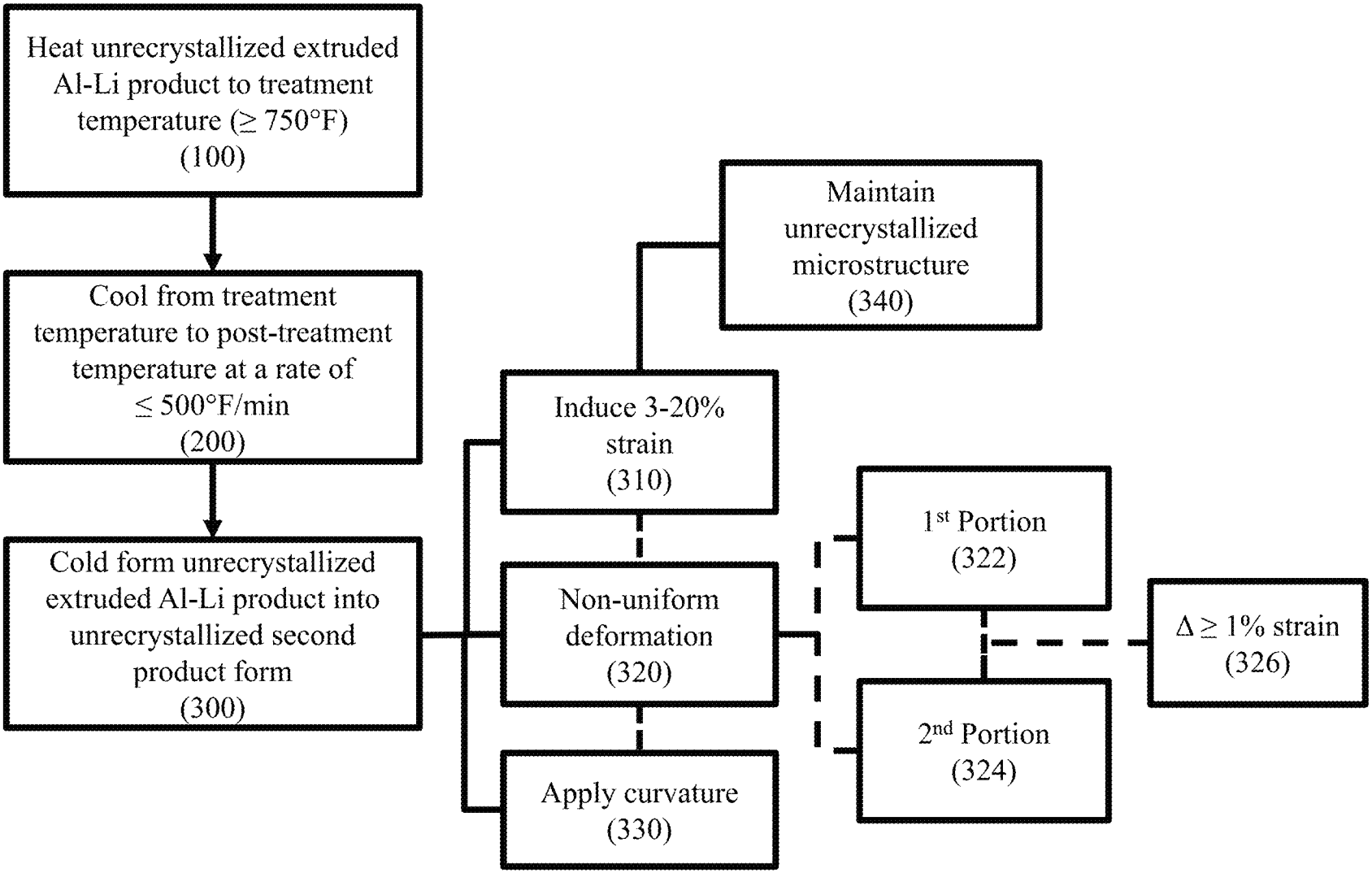
FIG. 4*a* illustrates additional embodiments of step (300) of FIG. 1 relating to deformation and related items.
Figure 4B:
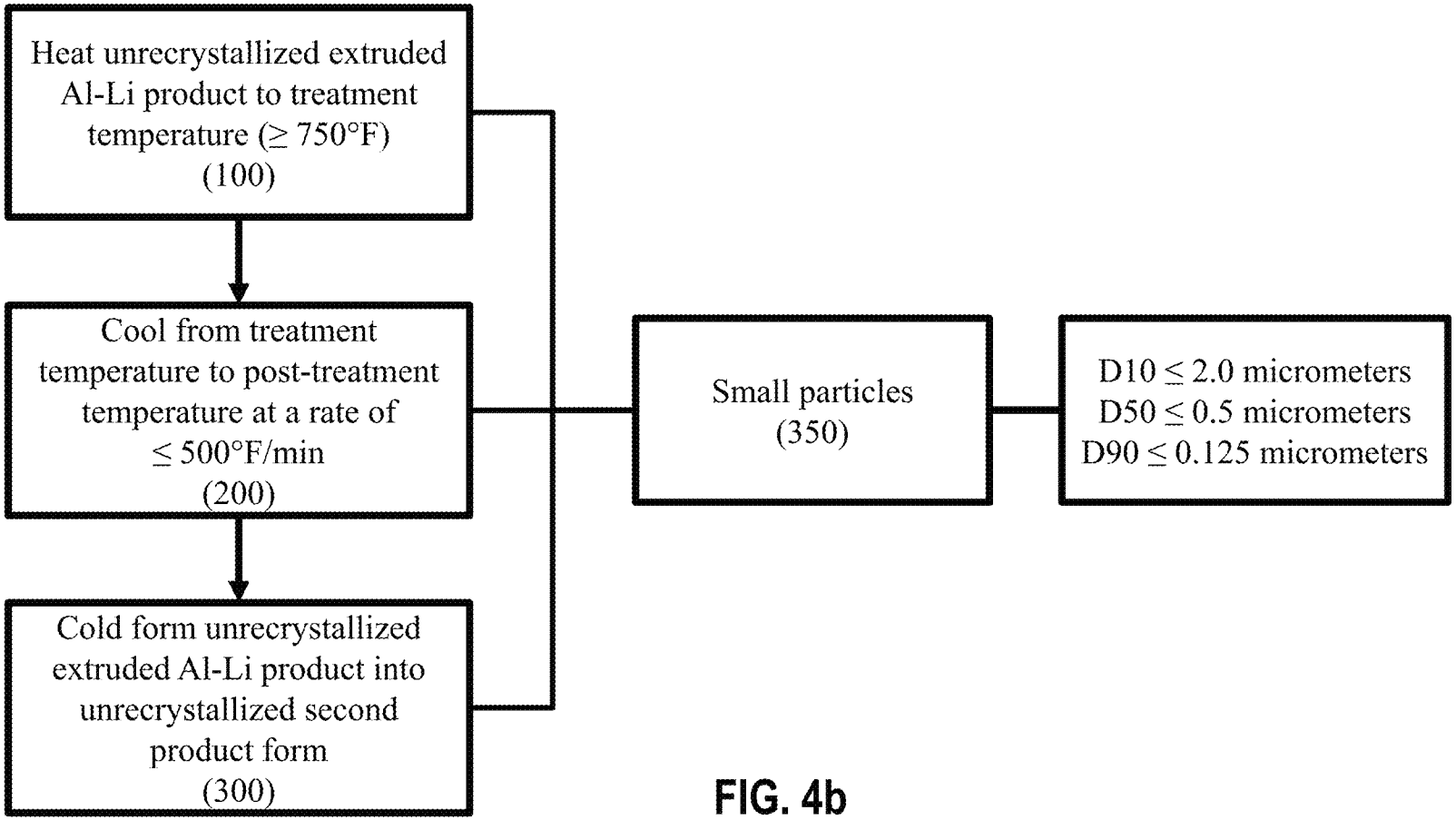
FIG. 4*b* illustrates additional embodiments of FIG. 1 relating to particle size distributions due to the methodology.
Figure 5A:
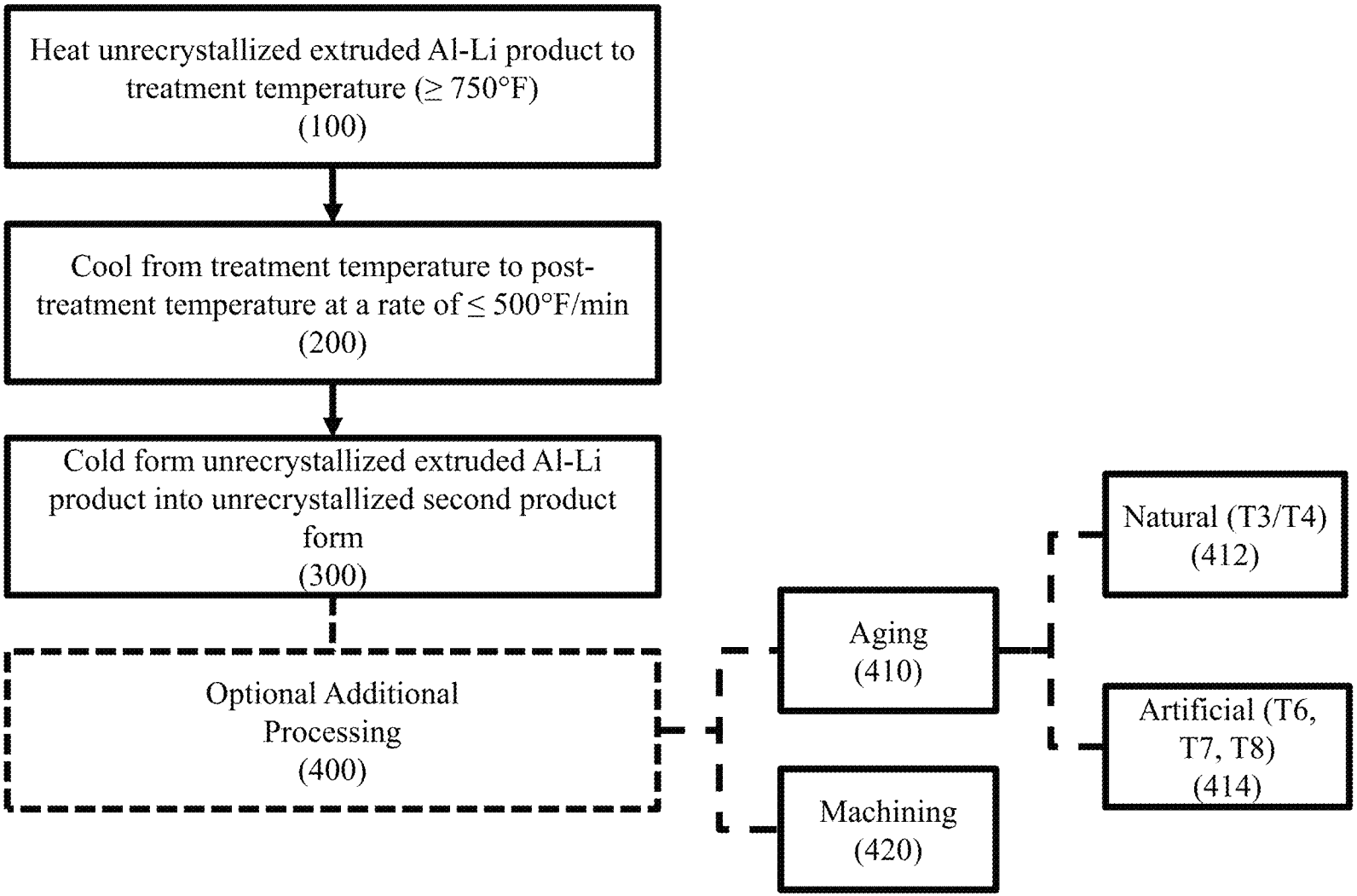
FIG. 5*a* illustrates optional additional processing (400) relating to the methodology.
Figure 5B:
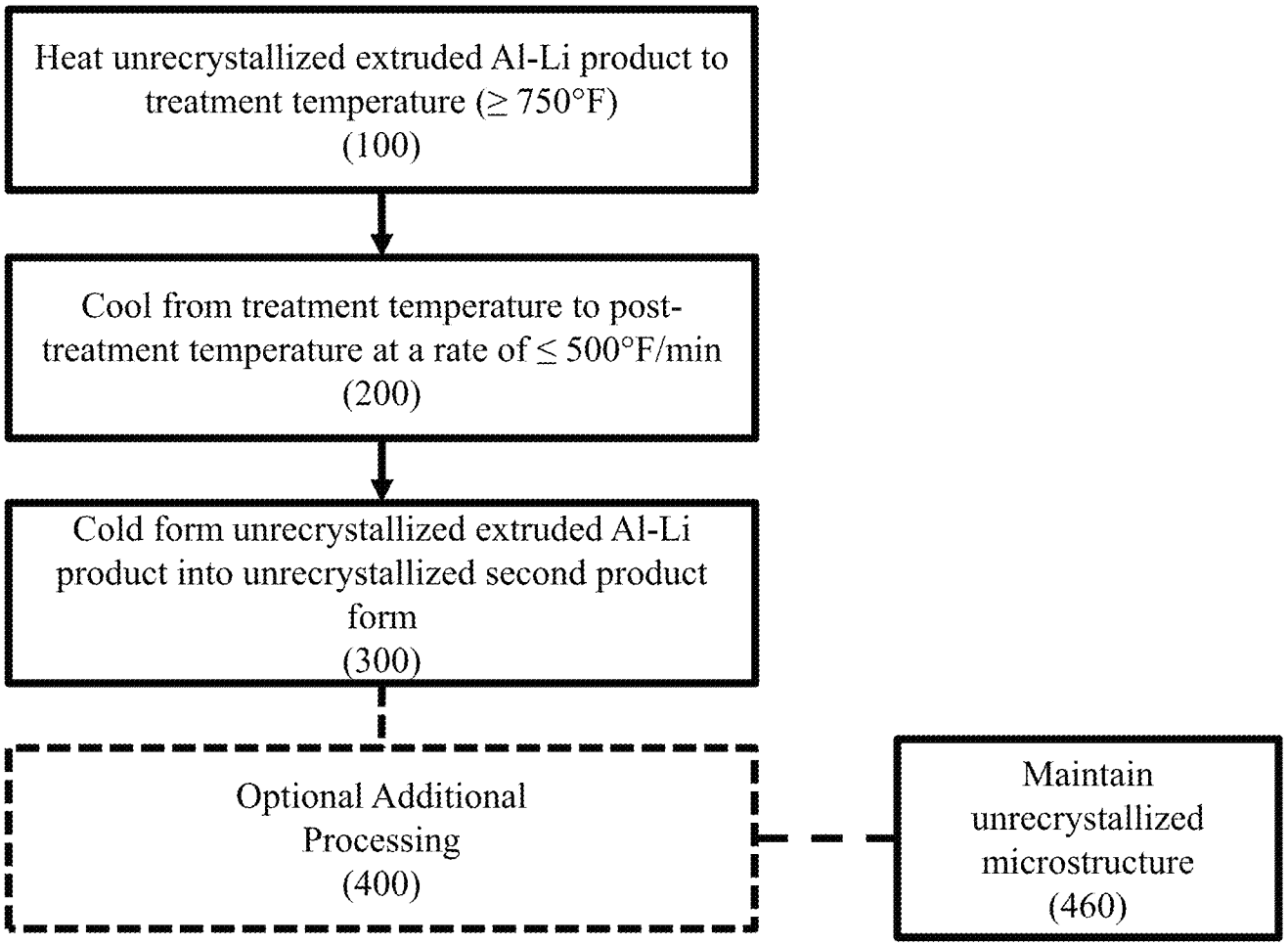
FIG. 5*b* illustrates additional embodiments of FIG. 5*a*.
Figure 6B:
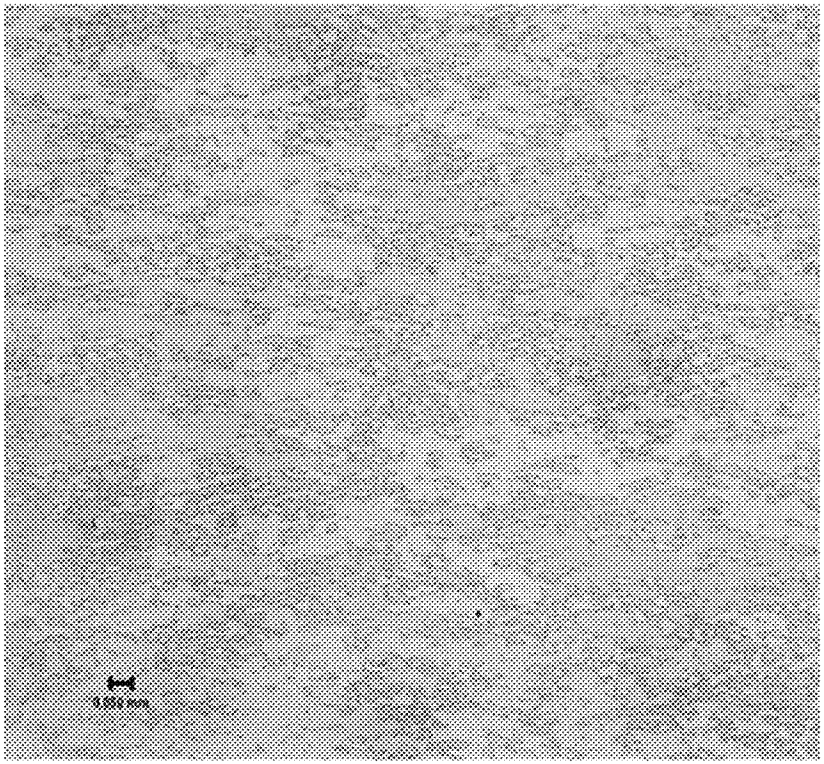
FIGS. 6*a*-6*b* are micrographs showing the microstructure of the typical products of Example 1.
Figure 6A:
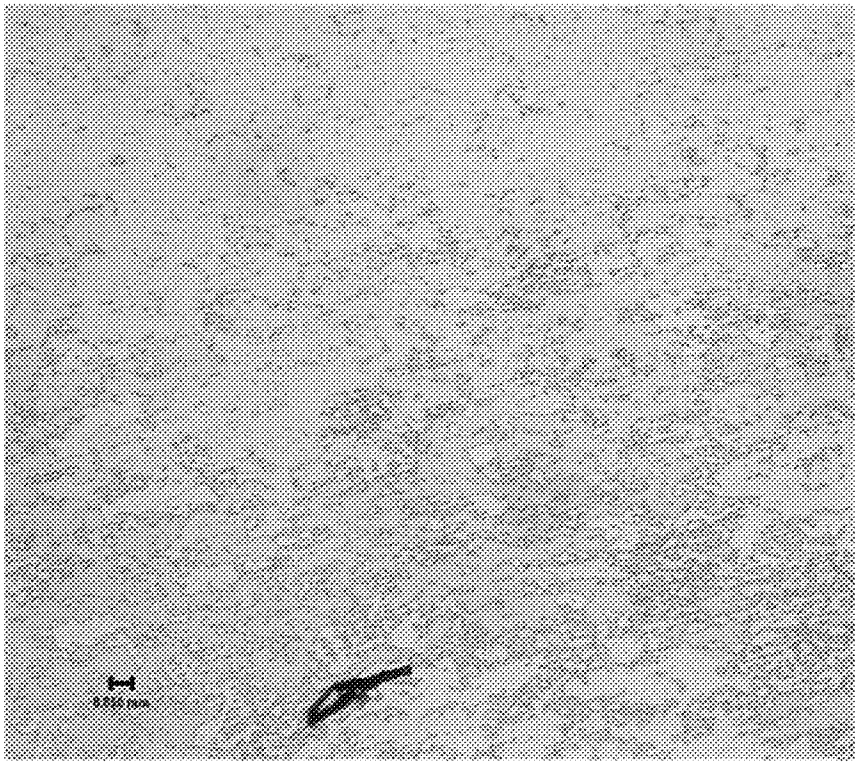

Example 1—Conventional Extrusion, Cold Forming and Solution Heat Treatment Results in Recrystallized Products A 2055-style aluminum alloy was extruded into a Z-shaped extrusion, resulting in an unrecrystallized aluminum-lithium extrusion. The material was cold formed into a final product shape by stretch forming. The material was then solution heat treated and cold water quenched. The final material was recrystallized as shown in FIG. 6.

Example 2—Intermediate Processing Resulting in Bulk Recrystallization

Figure 7:
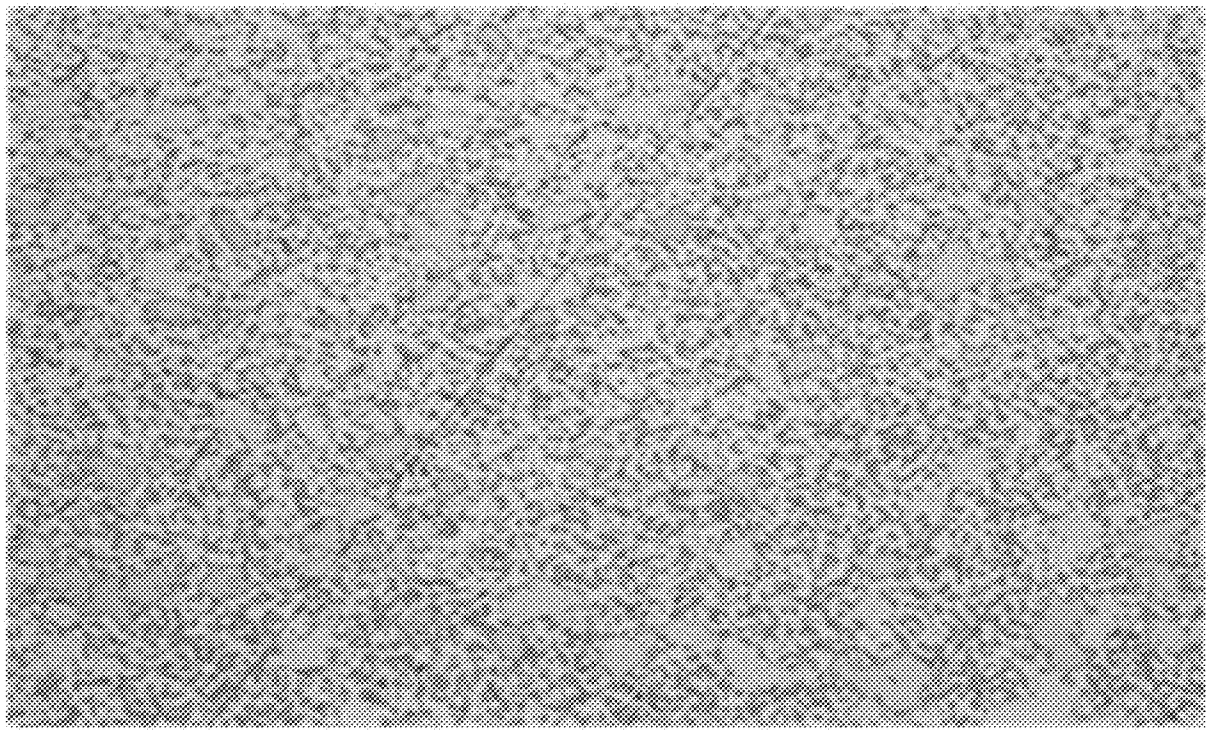
FIG. 7 is a micrograph showing the microstructure of the product of Example 2.

Given conventional processing (Example 1) yielded a recrystallized product, an intermediate thermal treatment practice was developed to stop/restrict transformation of the unrecrystallized extruded product into a recrystallized product. Specifically, a 2055-style aluminum alloy was extruded into a rectangular bar, resulting in a unrecrystallized aluminum-lithium extrusion. The rectangular bar was then thermally treated by rapidly heating to a 720° F. treatment temperature in a furnace. The material was held at the 720° F. treatment temperature (+/−10° F.) for 1 hour (the soak time started when the material reached a temperature of 690° F.). The material was then slowly cooled by changing the temperature of the furnace to 450° F. The material cooled from the 720° F. treatment temperature to the 450° F. treatment temperature at a rate of 50° F./hour. The material was held at the 450° F. treatment temperature (+/−10° F.) for 4 hours (the soak time started when the material reached a temperature of 465° F.). The material was then removed from the furnace and allowed to air cool. The material was then cold formed by uniaxially stretching the material to yield 8% permanent strain. The material was then solution heat treated and then quenched in cold water. Despite the intermediate thermal practice, the final material was still recrystallized, as shown in FIG. 7.

Example 3—Recovery Anneal Resulting in Bulk Recrystallization

Figure 8:
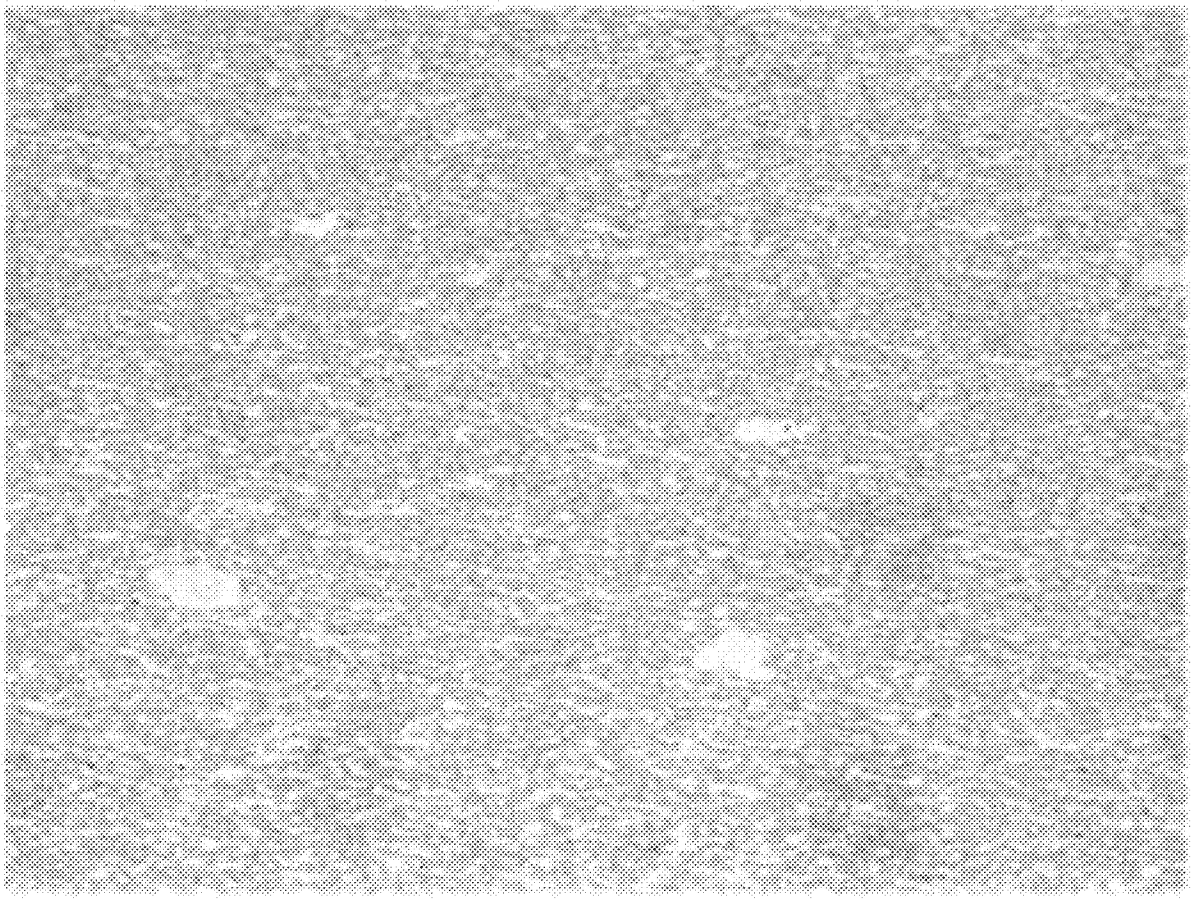
FIG. 8 is a micrograph showing the microstructure of the product of Example 3.
Figure 9B:
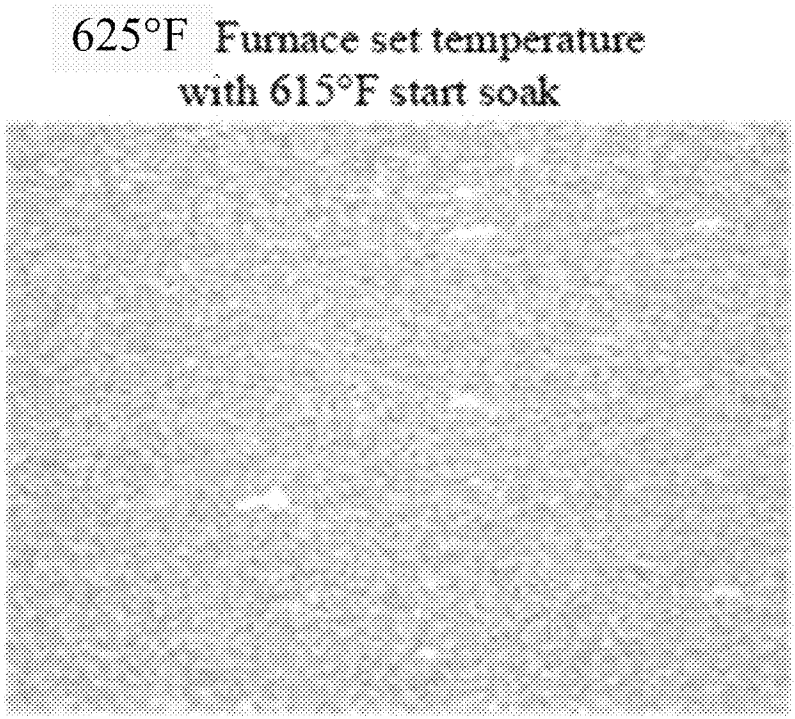
FIGS. 9*a*-9*f* are micrographs showing the microstructure of the products of Example 4.
Figure 9A:
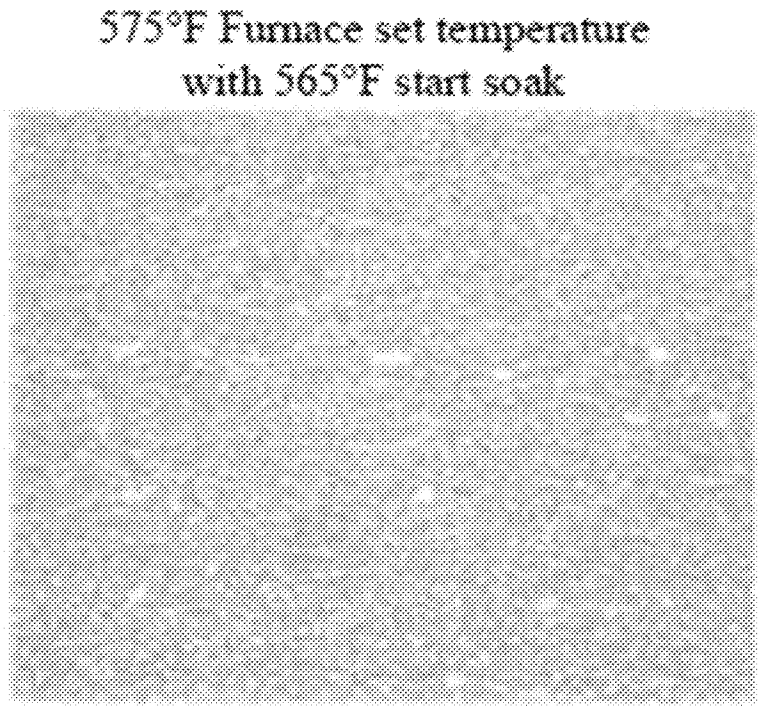
Figure 9D:
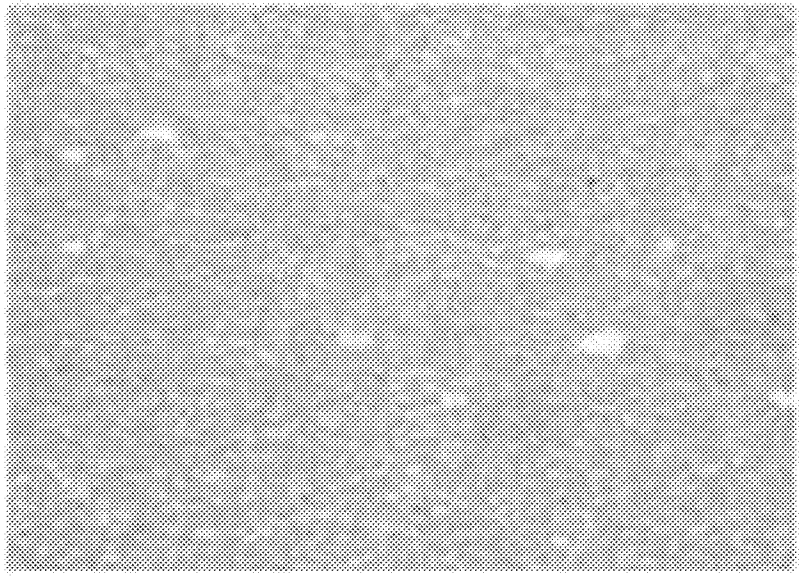
Figure 9C:
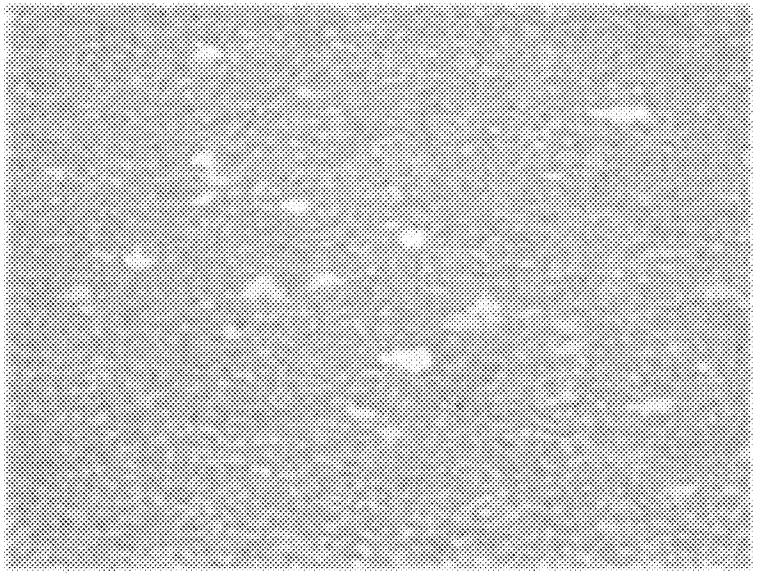
Figure 9F:
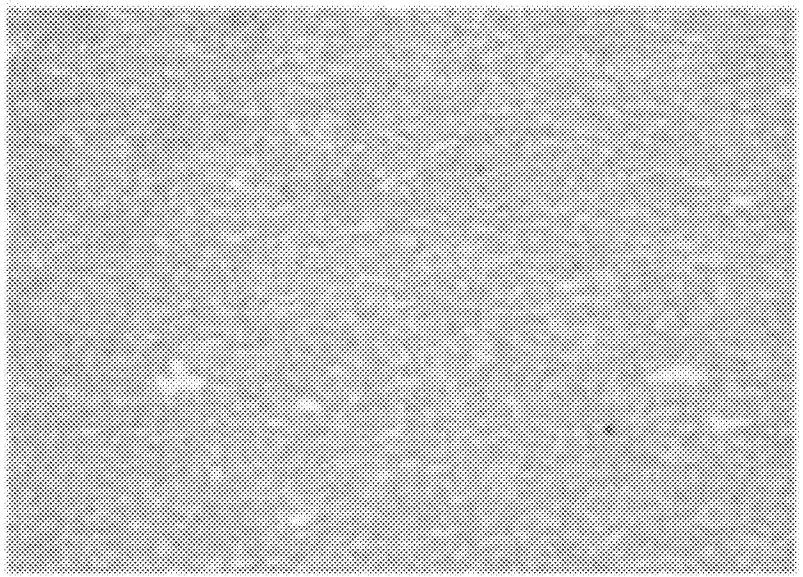
Figure 9E:
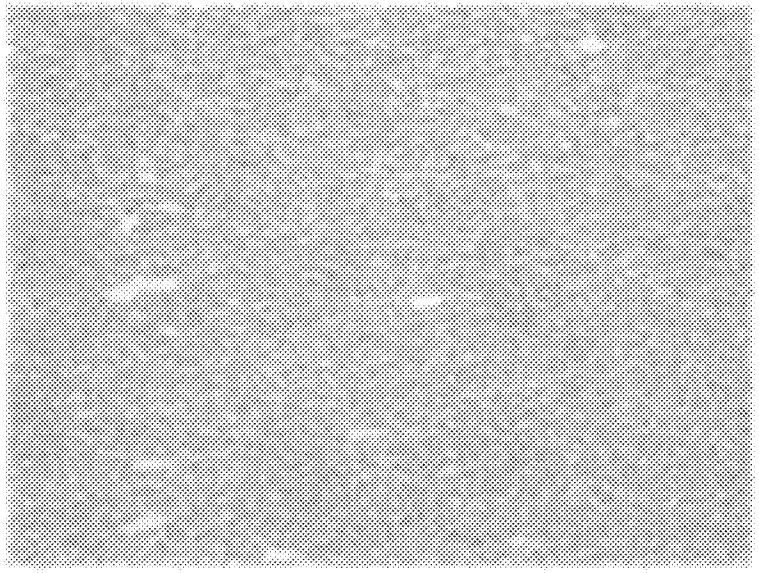

Additional efforts to produce final unrecrystallized products surrounded the use of a post cold-forming recovery anneal. Specifically, a 2055-style aluminum alloy was extruded into a rectangular bar, resulting in a unrecrystallized aluminum-lithium extrusion. The rectangular bar was then thermally treated as per Example 2, i.e., treated at both 720° F. and 450° F., and then allowed to air cool. The material was then cold formed by uniaxially stretching the material to yield 6% permanent strain. The material was then thermally treated by heating to 215° F. (3 hours), and then 400° F. (2 hours), and then 500° F. (3 hours), and then 600° F. (4 hours). The material was then solution heat treated and then quenched in cold water, as per Example 2. The final material was also recrystallized as shown in FIG. 8.

Example 4—Additional Recovery Anneals Result in Bulk Recrystallization

Building on the efforts of Example 3, additional recovery anneal tests were completed. Specifically, a 2055-style aluminum alloy was prepared and thermally treated prior to cold forming, as per Example 3. The material was then cold formed by uniaxially straining to yield 7% stretch. Various samples of this material were then rapidly heated to various anneal temperatures (525° F., 575° F., 675° F., 725° F., 775° F., and 875° F.). The materials were then solution heat treated and then quenched in cold water, as per Example 2. All final materials were recrystallized as shown in FIGS. 9*a*-9*f*.

Figure 10:
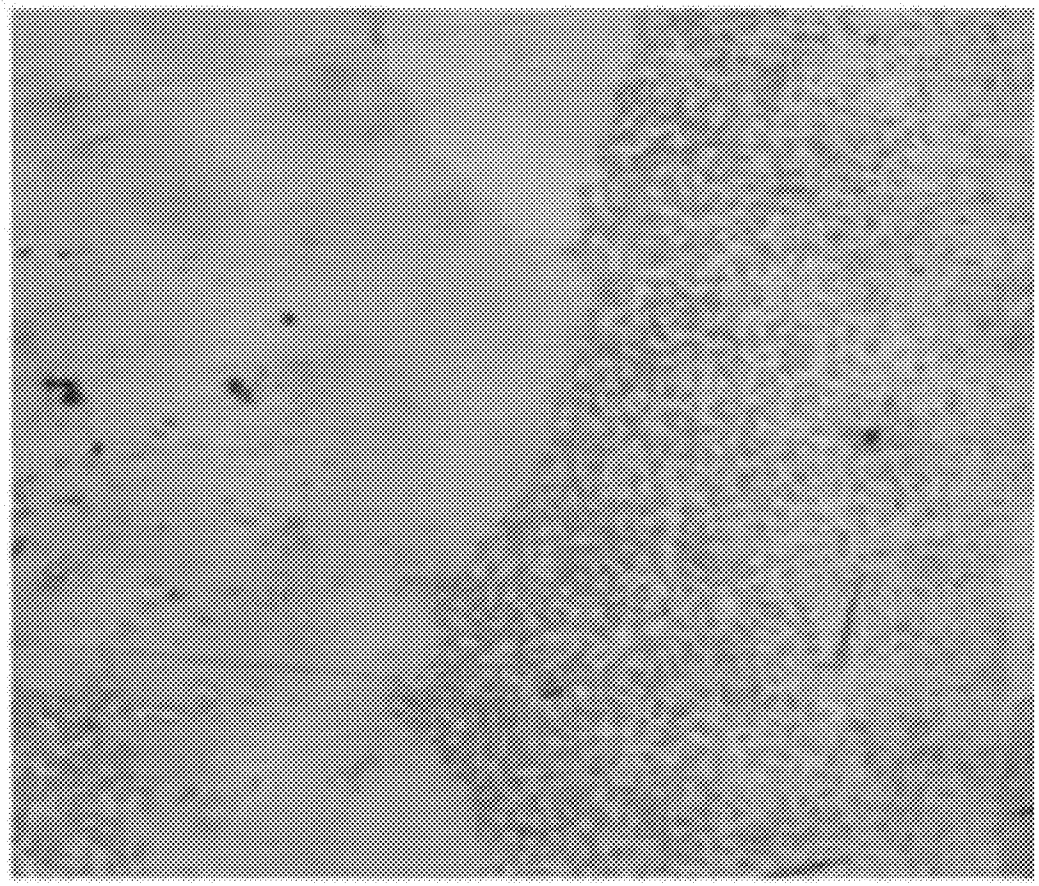
FIG. 10 is a micrograph showing the microstructure of the product of Example 5.

Example 5—Recovery Anneals Without Cold Forming Result in Bulk Recrystallization In Example 5, a 2055-style aluminum alloy was prepared and thermally treated, as per Example 2, except the material was extruded into a Z-shape. This time, the thermal treatment cycle was repeated three times (i.e., 3× at 720° F. and 450° F. as per Example 2). No cold forming operation was employed in this Example 5. Instead, after the three thermal cycle operations, the material was solution heat treated and then quenched in cold water, as per Example 2. Despite receiving no cold forming, the final material was still recrystallized as shown in FIG. 10.

Example 6—High Temperature Thermal Treatment Results in Unrecrystallized Products In Example 6, a 2055-style aluminum alloy was extruded into a rectangular bar, resulting in a unrecrystallized aluminum-lithium extrusion. The rectangular bar was then thermally treated by rapidly heating to a 945° F. treatment temperature in a furnace. The material was held at the 945° F. treatment temperature (+/−10° F.) for 1 hour (the soak time started when the material reached a temperature of 935° F.). Upon conclusion of the soak, the material was removed from the furnace and allowed to air cool to ambient temperature. The cooling rate for this cooling step was about 25° F. per minute. The material was then cold formed by uniaxially straining to yield 6% permanent strain. The material was then solution heat treated and quenched in cold water, as per Example 2. This time, the final material remained unrecrystallized.

Figure 11:
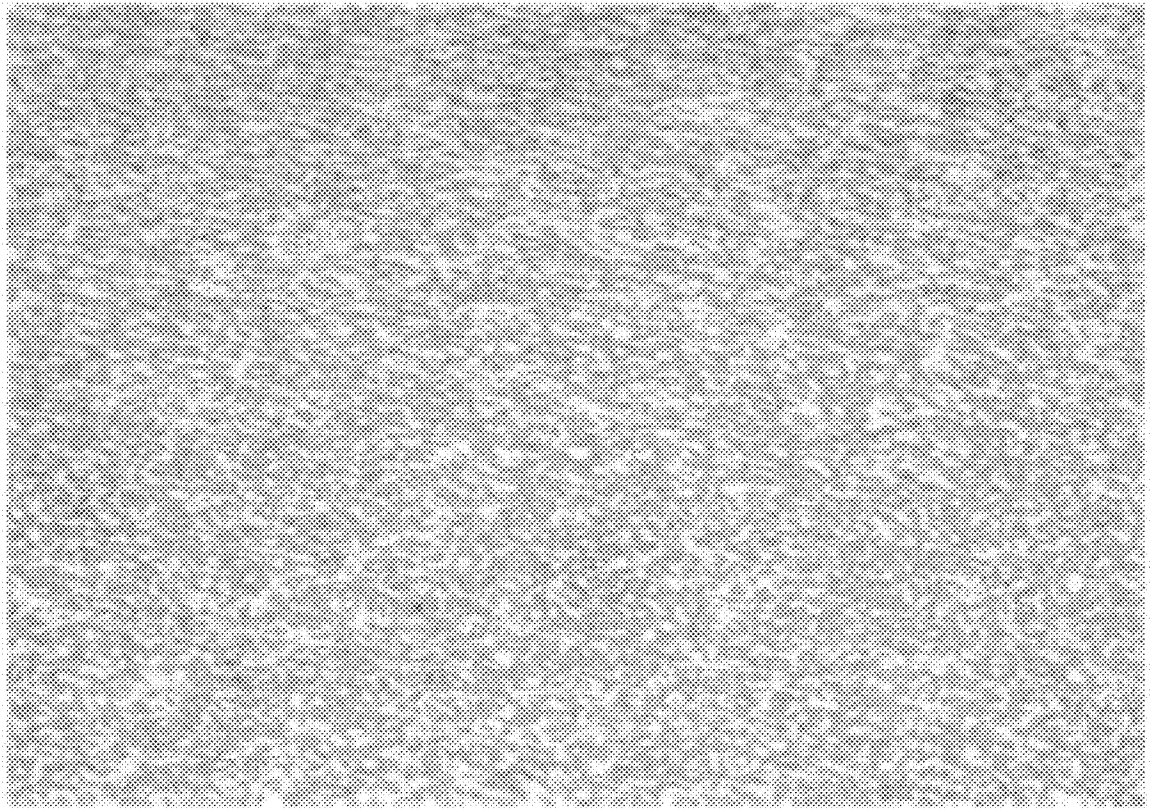
FIG. 11 is a micrograph showing the microstructure of the product of Example 7.

Example 7—Multiple High Temperature and Multiple Straining Operations Results in Unrecrystallized Products To test the robustness of this process, the same process as Example 6 was performed on an unrecrystallized 2055 extruded product, but with 4 thermal treatment cycles at 945° F. and with 4 corresponding strain operations following each thermal treatment cycles, each strain operation applying 6% permanent strain to the prior product. After the 4th strain operation, the material was solution heat treated and quenched in cold water, as per Example 2. Even after four strain operations, the final material remained unrecrystallized, as shown in FIG. 11, indicating the robustness of the process.

Figure 12:
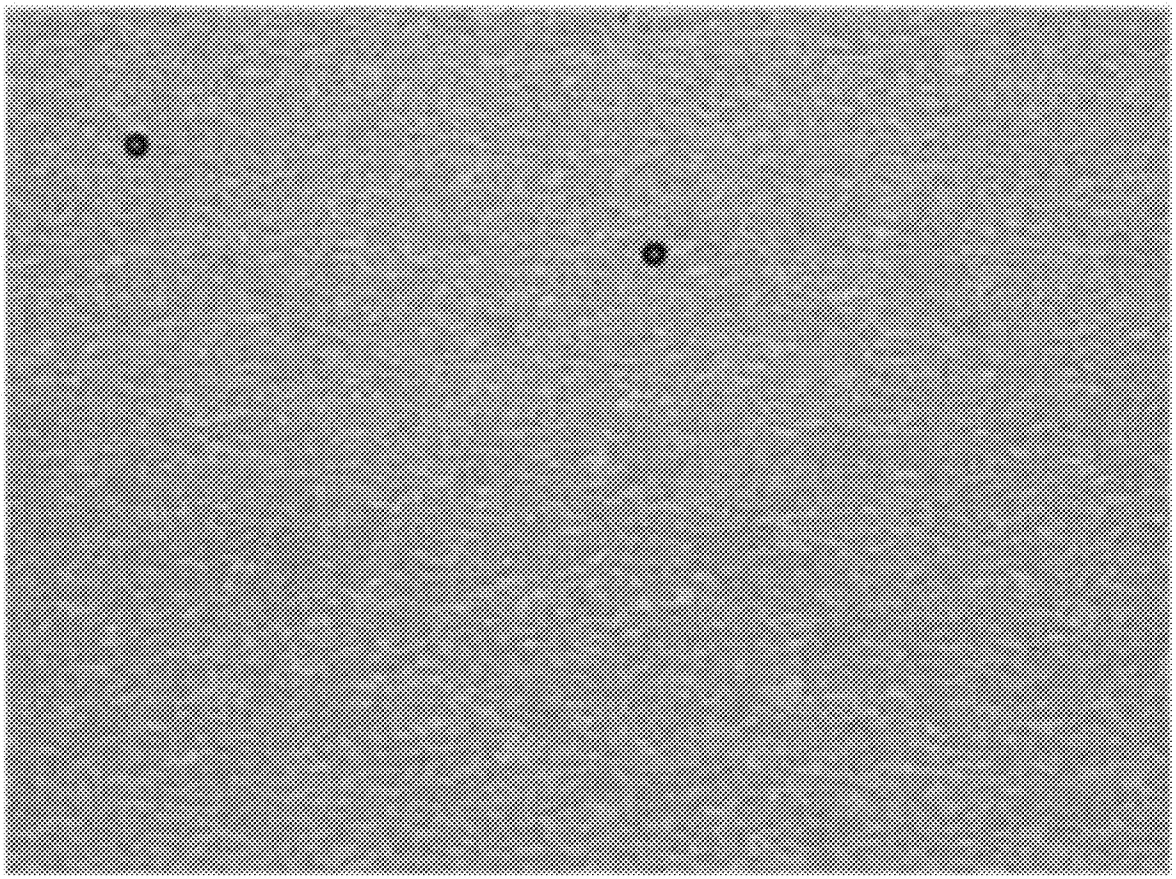
FIG. 12 is a micrograph showing the microstructure of the product of Example 8.

Example 8—Multiple High Temperature and Multiple Straining Operations Results in Unrecrystallized Products In Example 8, an unrecrystallized 2055 extruded product was thermally treated as per Example 2, i.e., treated at both 720° F. and 450° F., and then allowed to air cool. The material was not cold formed after this thermal treatment. Instead, an additional thermal treatment cycle was employed as per Example 6, i.e., treated by rapidly heating to a 945° F. treatment temperature in a furnace, holding at the 945° F. treatment temperature (+/−10° F.) for 1 hour (the soak time started when the material reached a temperature of 935° F.), and then removing the material from the furnace and allowing to air cool to ambient temperature. The material was then cold formed by uniaxially straining to yield 8% permanent strain. The material was then solution heat treated and quenched in cold water, as per Example 2. Again, the final material remained unrecrystallized as shown in FIG. 12.

Example 9—Grain Size Analysis

Figures 13A, 13B, 13C, 13D, 13E:
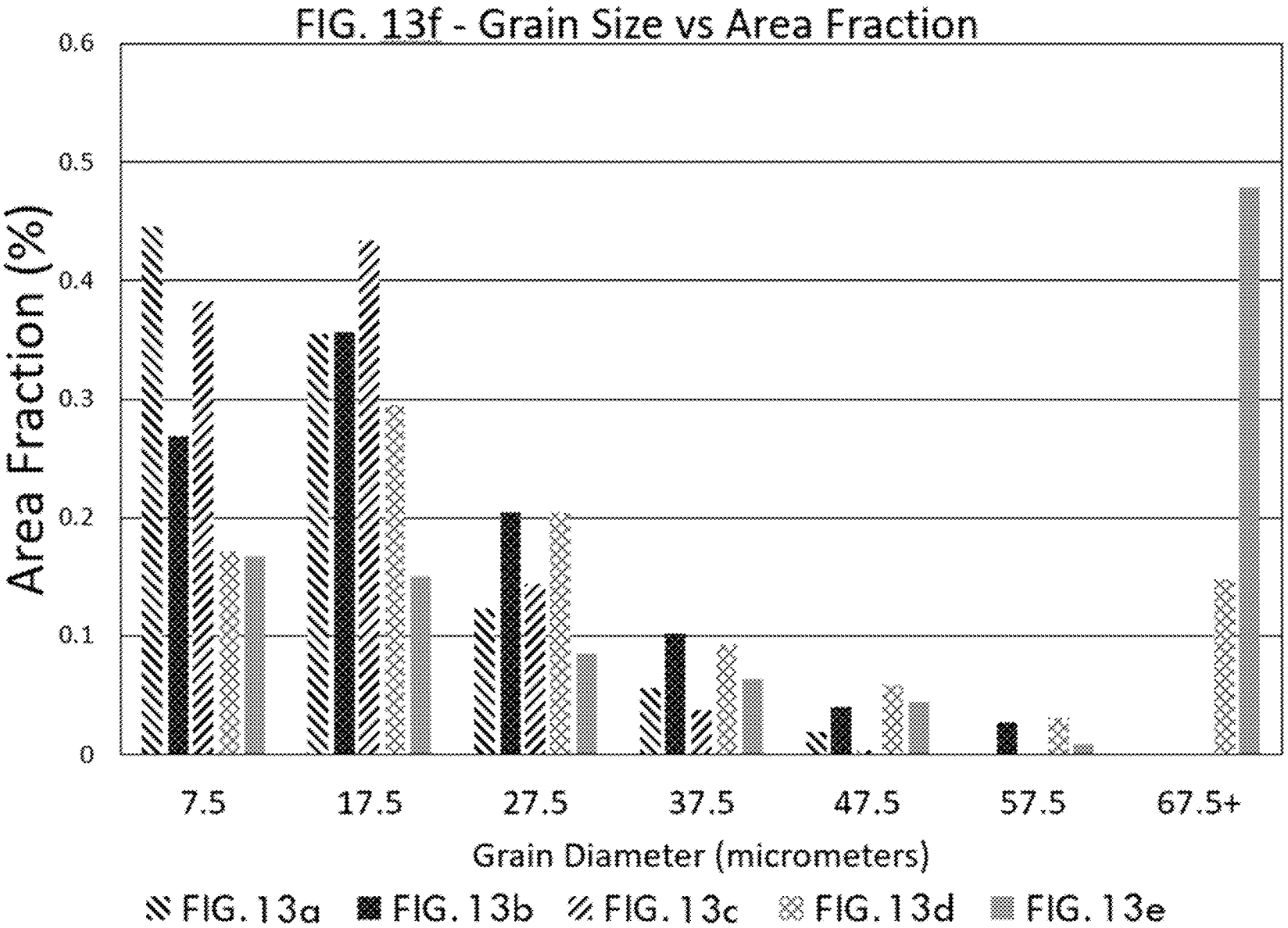
FIGS. 13*a*-13*e* are SEM images from Example 9.
Figure 13H:
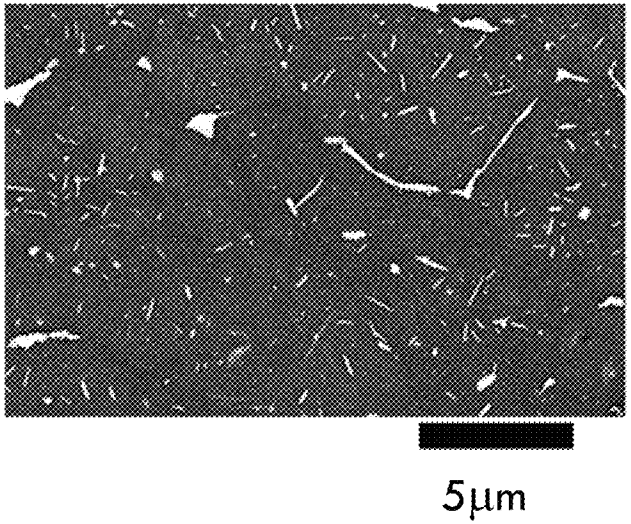
FIGS. 13*g*-13*h* are micrographs showing particles within a non-invention (13*g*) and an invention (13*h*) material.
Figure 13G:
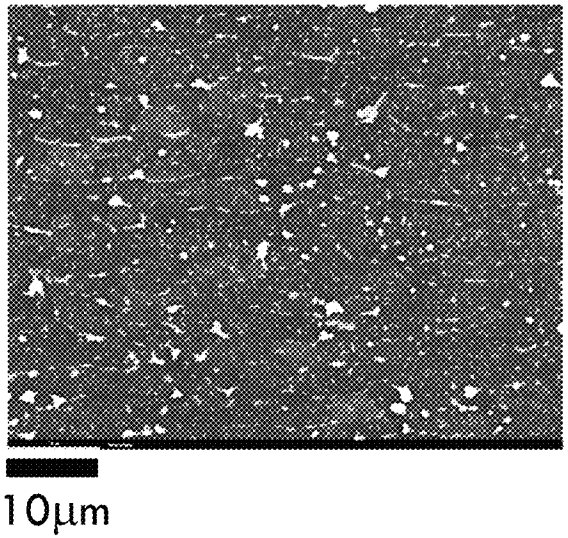

SEMs of several alloys made by the invention process and one alloy made by a non-invention process were obtained as per the Microstructure Determination Procedure. The grain sizes of these SEMs were calculated as per the Grain Size Computer Analysis Procedure. The SEMs are provided in FIGS. 13*a*-13*e*. As shown, the invention alloys all realize much smaller grains. This is confirmed by a computerized analysis. As shown in FIG. 13*f*, the non-invention alloy realized much larger grains than that of the invention alloys. This also can be seen in FIGS. 13*g*-13*h*, which are micrographs showing particles within a non-invention (13*g*) and an invention (13*h*) material. (Note: FIG. 13*g* uses a 10 micrometer scale; FIG. 13*h* uses a 5 micrometer scale.)

Given the foregoing examples, and without being bound to any particular theory, it is believed that the high temperature thermal treatment practice in combination with reasonable amounts of strain allows for the production of cold formed aluminum-lithium extruded products that retain unrecrystallized grains. Indeed, the final products generally contain a significant amount of unrecrystallized grains and relative to the starting products in the as-extruded condition.

Thus, in some embodiments, a "recrystallized" cold formed product is one who, based on the EBSD data and SEMs gathered above, realizes a microstructure (as per the SEMs) having an area fraction of at least 0.20% of large grains (≥67.5 micrometers (i.e., greater than or equal to 67.5 micrometers)) and in any one of the obtained samples. That is, if even one of the samples realizes these criteria, the material is categorized as recrystallized. In one embodiment, a recrystallized cold formed product realizes a microstructure having an area fraction of at least 25% of large grains. In another embodiment, a recrystallized cold formed product realizes a microstructure having an area fraction of at least 30% of large grains. In yet another embodiment, a recrystallized cold formed product realizes a microstructure having an area fraction of at least 35% of large grains. In another embodiment, a recrystallized cold formed product realizes a microstructure having an area fraction of at least 40% of large grains. In yet another embodiment, a recrystallized cold formed product realizes a microstructure having an area fraction of at least 45% of large grains, or higher.

In some embodiments, an unrecrystallized cold formed product is any product that is outside the above definition of a "recrystallized" cold formed product. In one embodiment, an unrecrystallized cold formed product also realizes or alternatively realizes a microstructure (as per the SEM and EBSD data) having an area fraction of not greater than 0.2% of grains of a size of from ≥57.5 to 67.4 micrometers. In another embodiment, an unrecrystallized cold formed product also realizes or alternatively realizes a microstructure having an area fraction of not greater than 0.15% of grains of a size of from ≥57.5 to 67.4 micrometers. In another embodiment, an unrecrystallized cold formed product also realizes or alternatively realizes a microstructure having an area fraction of not greater than 0.10% of grains of a size of from ≥57.5 to 67.4 micrometers.

In one embodiment, an unrecrystallized cold formed product also realizes or alternatively realizes a microstructure having an area fraction of not greater than 0.2% of grains of a size of from ≥47.5 to 57.4 micrometers. In another embodiment, an unrecrystallized cold formed product also realizes or alternatively realizes a microstructure having an area fraction of not greater than 0.15% of grains of a size of from ≥47.5 to 57.4 micrometers. In another embodiment, an unrecrystallized cold formed product also realizes or alternatively realizes a microstructure having an area fraction of not greater than 0.10% of grains of a size of from ≥47.5 to 57.4 micrometers.

In one embodiment, an unrecrystallized cold formed product also realizes or alternatively realizes a microstructure having an area fraction of not greater than 0.22% of grains of a size of from ≥37.5 to 47.4 micrometers. In another embodiment, an unrecrystallized cold formed product also realizes or alternatively realizes a microstructure having an area fraction of not greater than 0.17% of grains of a size of from ≥37.5 to 47.4 micrometers. In another embodiment, an unrecrystallized cold formed product also realizes or alternatively realizes a microstructure having an area fraction of not greater than 0.12% of grains of a size of from ≥37.5 to 47.4 micrometers.

Example 10—Particle Size Analysis

Various samples were obtained from materials processed consistent with the practices of Examples 2 (non-inventive) and Examples 6-8 (inventive). All samples were thermally treated and then air quenched in accordance with, or similar to, these examples. Backscattered SEM images of the sample were obtained and the images were then computer analyzed to determine the particle distributions/sizes for the various materials as per the Particle Size Computer Analysis Procedure.

Figure 14:
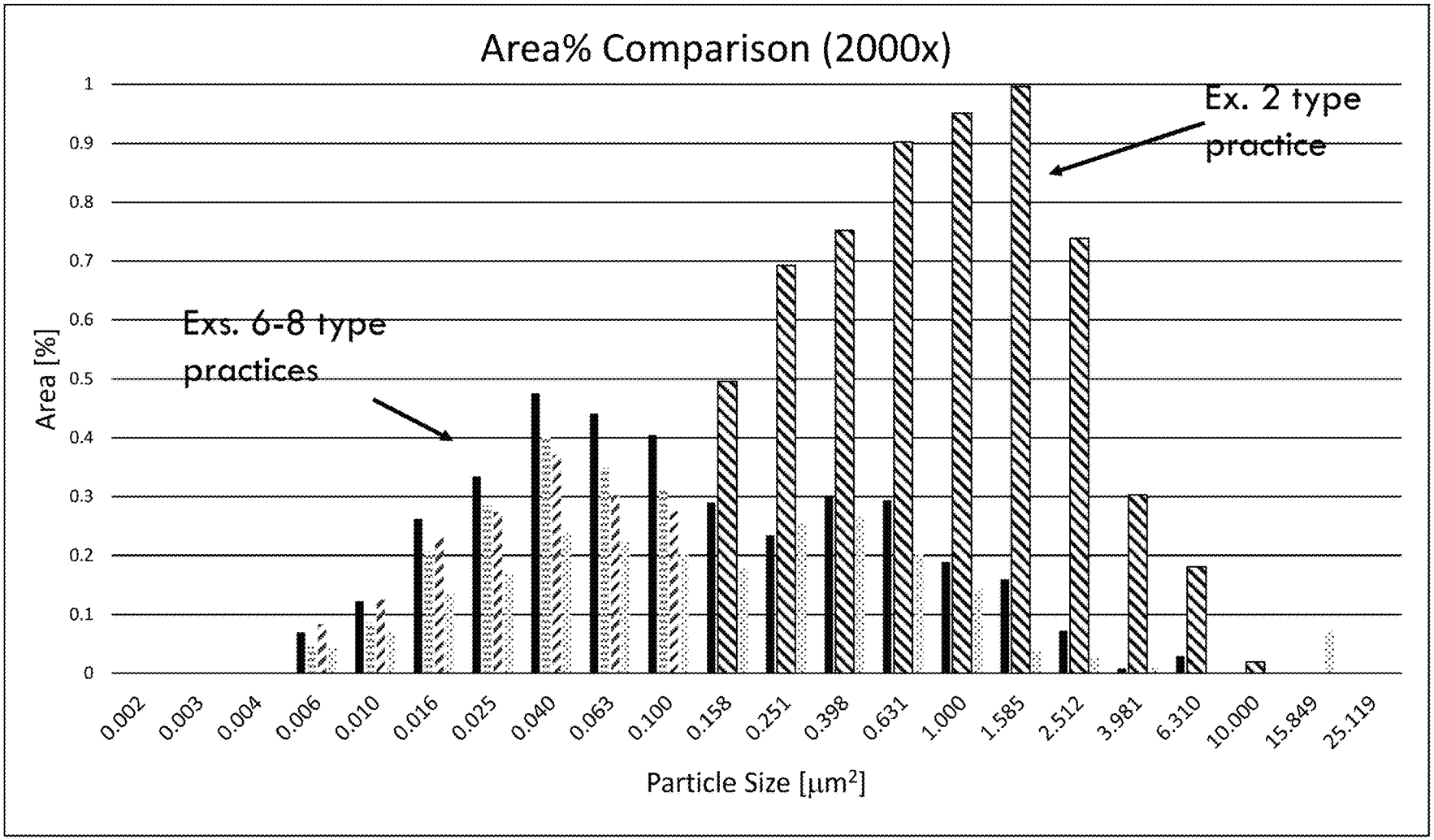
FIG. 14 is a graph showing particle size distribution results for a non-inventive practice and various inventive practices.
Figure 15B:
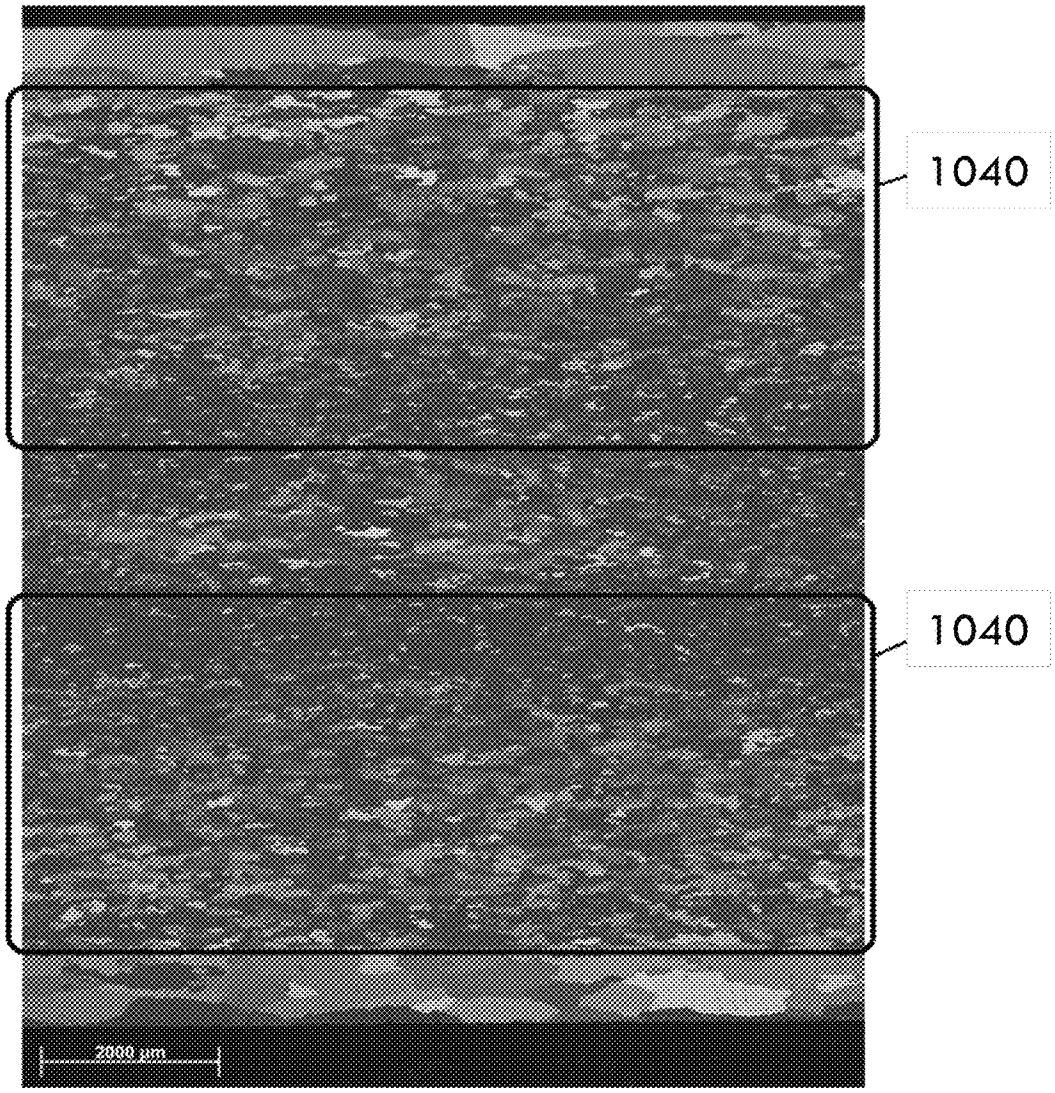
FIGS. 15*a*-15*b* are optical micrographs showing an inventive microstructure (FIG. 15*a*) versus a non-inventive microstructure (FIG. 15*b*).
Figure 15A:
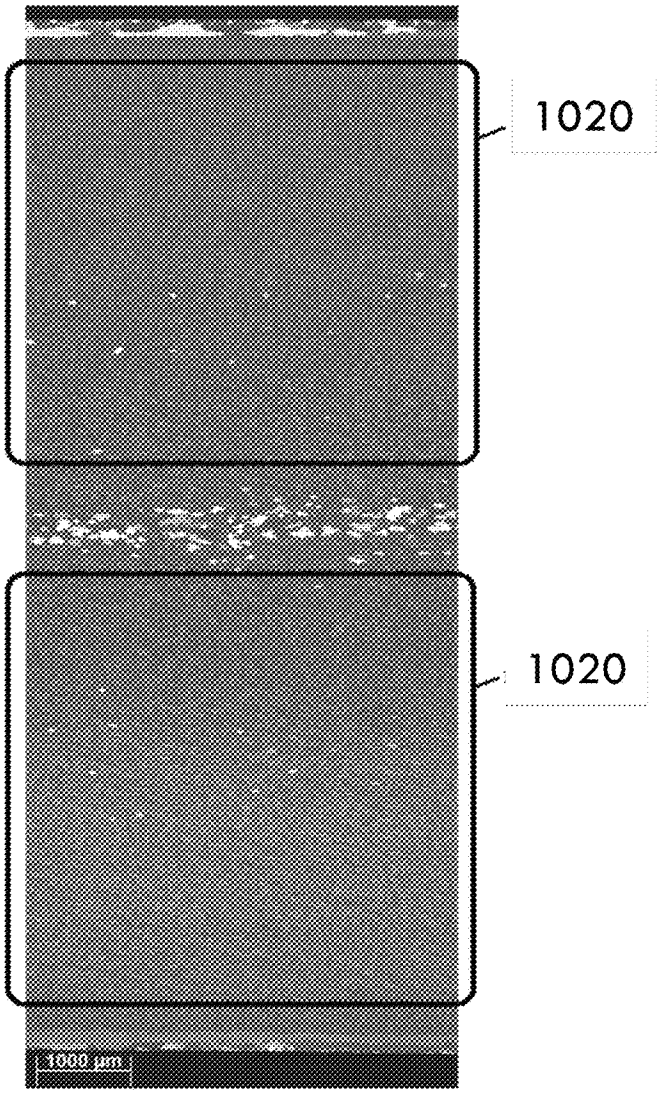

The particle size distributions for the various samples are shown in FIG. 14. As shown, the inventive practices (shown by the solid bars) generally have a much higher volume of small particles and the distribution is more even. The non-inventive practice (shown by the bars with hatching) of Ex. 2 realizes much larger particles and the distribution is more condensed. The specific D10, D50, and D90 values for the data of FIG. 14 is provided in Table 1, below.

TABLE 1

Particle Size Data for Example 10

| Practice Type | D10 (micro-meters) | D50 (micro-meters) | D90 (micro-meters) |
|---|---|---|---|
| Ex. 2-type (non-inventive) (TT at 720° F., cool to and TT at 450° F., and then air cool.) | 0.158 | 0.631 | 2.512 |
| Inventive (pink) (Single TT at 945° F., 5.5% stretch) | 0.016 | 0.063 | 0.631 |
| Inventive (green) (TT @ 945° F., 5.5% stretch, TT @ 945° F., 5.5% stretch) | 0.016 | 0.063 | 1.0 |
| Inventive (blue) (TT @ 945° F., 5.5% stretch, TT @ 945° F., 6.0% stretch, TT @ 945° F., 7.0% stretch) | 0.01 | 0.063 | 0.631 |
| Inventive (yellow) (TT @ 945° F., 5.8% stretch, TT @ 945° F., 6.0% stretch, TT @ 945° F., 5.5% stretch, TT @ 945° F., 6.3% stretch) | 0.016 | 0.1 | 1.0 |

Given the foregoing examples, and without being bound to any particular theory, it is believed that the high temperature thermal treatment practice in combination with the post-thermal treatment cooling rates and appropriate amounts of post-cooling strain produces unique unrecrystallized products having a distribution of small precipitate phase particles. As explained above in Section iii, higher concentrations of smaller precipitate phase particles (e.g., within the D10, D50, and D90 amounts described in Section iv) may facilitate grain boundary pinning while also reducing the amount of solute present during cold forming operations. The grain boundary pinning may restrict/prevent recrystallization. Further having a relatively low amount of nano-scale precipitate phases (e.g., <20 nanometers) may facilitate working of the material. Larger particles may also act as nucleation sites for recrystallization. Accordingly, the methods described herein seek to restrict/avoid the production of large scale and nano-scale particles, while having an appropriate amount of small precipitate phase particles. Thus, shape forming may be completed in a low number of cycles to achieve the final part geometry and in the unrecrystallized condition, followed by appropriate post-cold forming operations (e.g., solution heat treatment, post-SHT stretch to facilitate nucleation of aging precipitates, aging (natural and/or artificial), and machining, to name a few). Significant costs reductions may accordingly be realized.

While various embodiments of the present disclosure have been described in detail, it is apparent that modifications and adaptations of those embodiments will occur to those skilled in the art. However, it is to be expressly understood that such modifications and adaptations are within the spirit and scope of the present disclosure.

What is claimed is:

1. A method comprising:

prior to solution heat treatment, cold forming an unrecrystallized extruded aluminum-lithium product into a second product form;

(i) wherein the unrecrystallized extruded aluminum-lithium product comprises from 0.2-5.0 wt. % Li;

(ii) wherein the unrecrystallized extruded aluminum-lithium product is predominately unrecrystallized;

(iii) wherein the cold forming comprising initiating the cold forming when the unrecrystallized extruded aluminum-lithium product has a temperature of not greater than 400° F.;

(iv) wherein the cold forming comprises plastically deforming the unrecrystallized extruded aluminum-lithium product, wherein the plastically deforming comprises at least one of:

(A) non-uniformly deforming the unrecrystallized extruded aluminum-lithium product, wherein, due to the non-uniform deforming, a first portion of the second product form realizes a first strain amount and a second portion of the second product form realizes a second strain amount, wherein the first strain amount is at least 1% different than the second strain amount; and (B) applying curvature to the unrecrystallized extruded aluminum-lithium product, wherein the second product form comprises at least one arcuate surface;

(v) wherein the second product form is predominately unrecrystallized.

2. The method of claim 1, wherein, prior to the cold forming step, the method comprises:

heating the unrecrystallized extruded aluminum-lithium product to a treatment temperature, wherein the treatment temperature is at least 750° F.; and then cooling the unrecrystallized extruded aluminum-lithium product from the treatment temperature to a post-treatment temperature and at a cooling rate of not greater than 500° F./minute.

3. The method of claim 2, comprising:

second heating the second product form to a second treatment temperature, wherein the second treatment temperature is at least 750° F.;

second cooling the second product form from the second treatment temperature to a second post-treatment temperature;

second cold forming the second product form into another product form, wherein the another product form is predominately unrecrystallized.

4. The method of claim 3, wherein the second product form is an intermediate product form, wherein the another product form is a final product form, and wherein the second cooling comprises cooling the second product form from the second treatment temperature to the second post-treatment temperature at a rate of at least 1000° F./minute.

5. The method of claim 2, wherein the treatment temperature is below a solidus temperature of the unrecrystallized extruded aluminum-lithium product.

6. The method of claim 2, wherein the treatment temperature is from 85° F. below a solidus temperature of the unrecrystallized extruded aluminum-lithium product to 15° F. below a solidus temperature of the unrecrystallized extruded aluminum-lithium product.

7. The method of claim 2, wherein the heating comprises heating the unrecrystallized extruded aluminum-lithium product from a pretreatment temperature to the treatment temperature at a heating rate of at least 1° F. per minute.

8. The method of claim 2, wherein the heating comprises heating the unrecrystallized extruded aluminum-lithium product from a pretreatment temperature to the treatment temperature at a heating rate of not greater than 100° F. per minute.

9. The method of claim 2, wherein the heating comprises holding the unrecrystallized extruded aluminum-lithium product at the treatment temperature for a period of time sufficient to dissolve a predominate amount of precipitate phase particles but without recrystallizing the unrecrystallized extruded aluminum-lithium product.

10. The method of claim 2, wherein the cooling comprises cooling the unrecrystallized extruded aluminum-lithium product from the treatment temperature to the post-treatment temperature at a cooling rate of not greater than 400° F./minute.

11. The method of claim 2, wherein the treatment temperature is at least 800° F.

12. The method of claim 1, wherein the unrecrystallized extruded aluminum-lithium product is a 2xxx-Li product, and wherein the 2xxx-Li product comprises from 2.0-5.0 wt. % Cu, 0.2-2.0 wt. % Li, up to 1.5 wt. % Mg, up to 1.0 wt. % Ag, up to 1.0 wt. % Mn, up to 1.5 wt. % Zn, up to 0.25 wt. % each of Zr, Ti, Sc, and Hf, the balance being aluminum, optional incidental elements and impurities.

13. The method of claim 1, wherein the unrecrystallized extruded aluminum-lithium product is at least 60% unrecrystallized.

14. The method of claim 13, wherein the second product form is at least 60% unrecrystallized.

15. The method of claim 1, wherein the cold forming comprising including from 3% to 20% strain in the second product form.

16. The method of claim 1, wherein the cold forming comprises initiating the cold forming when the unrecrystallized extruded aluminum-lithium product has a temperature of not greater than 300° F.

17. The method of claim 1, wherein the cold forming comprises initiating the cold forming when the unrecrystallized extruded aluminum-lithium product is at ambient temperature.

18. The method of claim 1, wherein the cold forming is stretch forming.

* * * * *